US008620017B2

(12) United States Patent
Konuma et al.

(10) Patent No.: US 8,620,017 B2
(45) Date of Patent: Dec. 31, 2013

(54) SPEAKER AND MAGNETIC CIRCUIT

(75) Inventors: Sinsuke Konuma, Yamagata (JP); Satoshi Hachiya, Yamagata (JP); Koji Maekawa, Yamagata (JP)

(73) Assignees: Pioneer Corporation, Tokyo (JP); Tohoku Pioneer Corporation, Tendo (JP)

( * ) Notice: Subject to any disclaimer, the term of this patent is extended or adjusted under 35 U.S.C. 154(b) by 1322 days.

(21) Appl. No.: 12/093,740

(22) PCT Filed: Nov. 10, 2006

(86) PCT No.: PCT/JP2006/322501

§ 371 (c)(1),
(2), (4) Date: May 15, 2008

(87) PCT Pub. No.: WO2007/058133

PCT Pub. Date: May 24, 2007

(65) Prior Publication Data

US 2009/0161905 A1 Jun. 25, 2009

(30) Foreign Application Priority Data

Nov. 15, 2005 (JP) ..... 2005-330080

(51) Int. Cl.
*H04R 1/00* (2006.01)

(52) U.S. Cl.
USPC ..... 381/407; 381/424; 381/430; 381/432

(58) Field of Classification Search
USPC ..... 381/420, 415, 407, 423, 424, 430, 432
See application file for complete search history.

(56) References Cited

U.S. PATENT DOCUMENTS 3,955,055 A * 5/1976 Kawakami et al. ..... 381/430
5,719,946 A * 2/1998 Terauchi et al. ..... 381/401

(Continued)

FOREIGN PATENT DOCUMENTS

JP 54-14721 2/1979
JP 57-28498 A 2/1982

(Continued)

*Primary Examiner* — Charles Garber
*Assistant Examiner* — Reema Patel
(74) *Attorney, Agent, or Firm* — Arent Fox LLP

(57) ABSTRACT

A high performance speaker is provided and includes a simple structure magnetic circuit achieved without the need of a complicated manufacturing process, and a high performance speaker is provided and includes a simple structure diaphragm achieved without the need of a difficult process for forming a U shape of a narrow width in the diaphragm. A speaker 100 is equipped with an inner-magnet-type magnetic circuit 4 provided with a magnet 1, a plate 2 and a yoke 3, a voice coil 7, and a diaphragm 6 supporting the voice coil 7 in place close to the end of the plate 2 while allowing the voice coil to vibrate. The yoke 3 is formed in an approximately flat plate shape having a diameter equal to or larger than that of the plate 2. The diaphragm 6 has a dome-shaped vibrating section 61 formed in a central portion, a cone-shaped vibrating section 63 having an outer periphery supported by a speaker frame 5, and a voice coil bobbin 62 which is formed between the dome-shaped vibrating section 61 and the cone-shaped vibrating section 63. The voice coil bobbin 62 is formed in an L-shaped cross section bending outward from an end of a tubular portion in which the voice coil 7 is mounted. The dome-shaped and cone-shaped vibrating sections and the voice coil bobbin are molded together in one piece.

23 Claims, 23 Drawing Sheets

(56) References Cited

U.S. PATENT DOCUMENTS

| | | | | |
|---|---|---|---|---|
| 6,868,167 | B2 * | 3/2005 | Tsuda | 381/415 |
| 2003/0031338 | A1 * | 2/2003 | Suzuki et al. | 381/398 |
| 2004/0170297 | A1 * | 9/2004 | Hikichi | 381/430 |
| 2004/0197005 | A1 * | 10/2004 | Lenhard-Backhaus et al. | 381/409 |
| 2004/0240702 | A1 * | 12/2004 | Kaiwa et al. | 381/423 |
| 2006/0262956 | A1 * | 11/2006 | Ishigaki et al. | 381/410 |

FOREIGN PATENT DOCUMENTS

| | | | | |
|---|---|---|---|---|
| JP | 61-135300 | A | 6/1986 | |
| JP | 4-500890 | A | 2/1992 | |
| JP | 05-030592 | A | 2/1993 | |
| JP | 8-149596 | A | 6/1996 | |
| JP | 9-9392 | A | 1/1997 | |
| JP | 10-51892 | A | 2/1998 | |
| JP | 6-73999 | U | 10/1998 | |
| JP | 11-113089 | * | 4/1999 | H04R 9/02 |
| JP | 2003-274485 | A | 9/2003 | |
| JP | 2004-343386 | A | 12/2004 | |
| JP | 2004-356834 | A | 12/2004 | |
| JP | 2005-73129 | A | 3/2005 | |
| JP | 2005-102166 | A | 4/2005 | |
| JP | 2005-192119 | A | 7/2005 | |
| JP | 2005-204215 | A | 7/2005 | |
| WO | WO 90/04317 | A1 | 4/1990 | |

* cited by examiner

100m

100n

SPEAKER AND MAGNETIC CIRCUIT

TECHNICAL FIELD

The present invention relates to a speaker and a magnetic circuit.

BACKGROUND ART

A speaker provided in an audio system and the like is a form of electric transducer which converts an electric signal (electric energy) received from an amplifier to an acoustic signal (acoustic energy). Speakers fall into certain broad categories based on the operating principle: dynamic speaker, electrostatic speaker, piezoelectric speaker, discharge speaker, electromagnetic speaker, for example. Among these, the currently predominating type is the dynamic speaker which has a high performance and additionally meets various requirements such as those relating to sound quality. An example of the dynamic speakers will be described below in detail.

As illustrated in FIG. 1(*a*), a speaker disclosed in, for example, Patent Document 1 includes an edge 102 connecting the periphery of a diaphragm 101 to a yoke 103 which holds the diaphragm 101 in place through the edge 102. A magnet 104 is disposed on the upper face of the approximately U-shaped cross-section yoke 103. A top plate 105 is provided on the upper face of the magnet 104. The yoke 103, the magnet 104 and the top plate 105 form a magnetic circuit 106. The periphery end of the yoke 103 is bent in the direction of the top plate 105. A voice coil 107 is disposed in the magnetic gap created between the periphery end of the yoke 103 and the top plate 105. The magnetic circuit 106 has a structure in which the magnet 104 is disposed inside the voice coil 107, and is thus called an inner-magnet-type magnetic circuit. Hereinafter, the surface of the diaphragm on the acoustic radiation side is referred to as the front face and the surface of the diaphragm facing the magnetic circuit is referred to as the rear face. In addition, with regard to the magnet, the yoke and the plate, the faces facing the diaphragm are referred to as the upper faces and the faces on the opposite side to the diaphragm are referred to as the lower faces.

On the other hand, Patent Document 2 discloses a speaker comprising an outer-magnet-type magnetic circuit having the magnet disposed outside the voice coil. As illustrated in FIG. 1(*b*), the speaker has a ring-shaped magnet 14 mounted on a yoke 13 on which a pole 11 and an engagement step 12*a* are formed. A plate 15 having an engagement protrusion 15*b* is mounted on the top of the magnet 14. A dome-shaped diaphragm 16 is provided above the pole 11 of the yoke 13. A U-shaped cross-sectional voice coil bobbin 17 is provided on the outer rim of the diaphragm 16, and is supported by an edge 18. The diaphragm 16, the voice coil bobbin 17 and the edge 18 are integrally molded. A voice coil 17*a* is stored in the recessed portion of the voice coil bobbin 17. And, a frame 19 is disposed above and on the plate 15.

Patent Document 1: Japanese Patent Unexamined Publication No. 2005-102166

Patent Document 2: Japanese Patent Unexamined Publication No. H5-30592

DISCLOSURE OF THE INVENTION

Problems to be Solved by the Invention

However, the speaker disclosed in Patent Document 1 needs a complicated machining process for shaping the yoke 3 into a U-shaped cross-section. In addition, the speaker requires the process of bending the end of the U-shaped yoke 3 inward for the purpose of concentrating magnetic flux in the magnetic gap.

The speaker disclosed in Patent Document 2 is required to have the diaphragm highly accurately equipped with the U-shaped cross-sectional voice coil bobbin 17 having a deep groove of a relatively narrow width, so that the voice coil 17*a* can be disposed in a narrow magnetic gap defined between the outer periphery of the yoke 13 and the inner periphery of the plate 15. Accordingly, conventional speakers have the problem of a long time period being required for the shaping process.

Another disadvantage is that, since the voice coil is heated by Joule heat generated in the drive current and/or a frictional heat generated by vibration, such heating causes a reduction in the magnetic force of the magnetic circuit, deformation of the diaphragm and the like. Thus, desirable is a speaker which is capable of dissipating the heat of the magnetic circuit with a simple structure.

The present invention is an example of an attempt to counter such disadvantageous problems. Specifically, for example, objects of the present invention are to provide a high performance speaker comprising a simple-structure-magnetic circuit without the need of a complicated manufacturing process, and a simple-structure diaphragm without the need of a difficult process for forming a U shape of a narrow width in the diaphragm, and to achieve heat dissipation from a magnetic circuit in a simple structure.

Means for Solving the Problems

To attain these objects, the present invention has at least structures as described in the following independent claims.

According to an invention as described in claim 1, there is provided a speaker comprising: an inner-magnet-type magnetic circuit provided with a magnet, a plate disposed on one pole of the magnet, and a yoke disposed on the other pole of the magnet; a voice coil disposed close to an end of the plate of the magnetic circuit; and a diaphragm supporting the voice coil in place close to the end of the plate while allowing the voice coil to vibrate, wherein the yoke is formed in an approximately flat plate shape having a diameter equal to or larger than that of the plate.

According to an invention as described in claim 2, there is provided a speaker comprising: an outer-magnet-type magnetic circuit provided with a magnet, a plate disposed on one pole of the magnet, and a yoke disposed on the other pole of the magnet; a voice coil disposed close to an end of the plate of the magnetic circuit; and a diaphragm supporting the voice coil in place close to the end of the plate while allowing the voice coil to vibrate, wherein the yoke is formed in an approximately flat plate shape having a diameter equal to or larger than that of the plate.

According to an invention as described in claim 3, there is provided a speaker comprising: a magnetic circuit provided with a magnet and a yoke disposed on one of poles of the magnet; a voice coil disposed close to an end of the magnet; and a diaphragm supporting the voice coil in place close to the end of the magnet while allowing the voice coil to vibrate, wherein the yoke is formed in an approximately flat plate shape.

According to an invention as described in claim 20, there is provided a magnetic circuit comprising: a magnet; a plate disposed on one pole of the magnet; and a yoke disposed on the other pole of the magnet, wherein the yoke is formed in an approximately flat plate shape having a diameter equal to or larger than that of the plate.

According to an invention as described in claim 21, there is provided a magnetic circuit for an outer-magnet-type speaker, comprising: a magnet; a plate disposed on one pole of the magnet; and a yoke disposed on the other pole of the magnet, wherein the yoke is formed in an approximately flat plate shape having a diameter equal to or larger than that of the plate.

According to an invention as described in claim 22, there is provided a magnetic circuit for a speaker, comprising a magnet and a yoke disposed on one pole of the magnet, wherein the yoke is formed in an approximately flat plate shape.

BRIEF DESCRIPTION OF THE DRAWINGS

FIG. 1(*b*) is a sectional view illustrating a speaker having a conventional outer-magnet-type magnetic circuit.

FIG. 5(*b*) is a sectional view of the diaphragm 6 shown in FIG. 5(*a*).

FIG. 17(*b*) is a graph showing the frequency characteristics of a conventional speaker having a magnetic circuit including a relatively narrow magnetic gap with or without magnetic fluid to be provided.

THE BEST MODE FOR CARRYING OUT THE INVENTION

Figure 1:
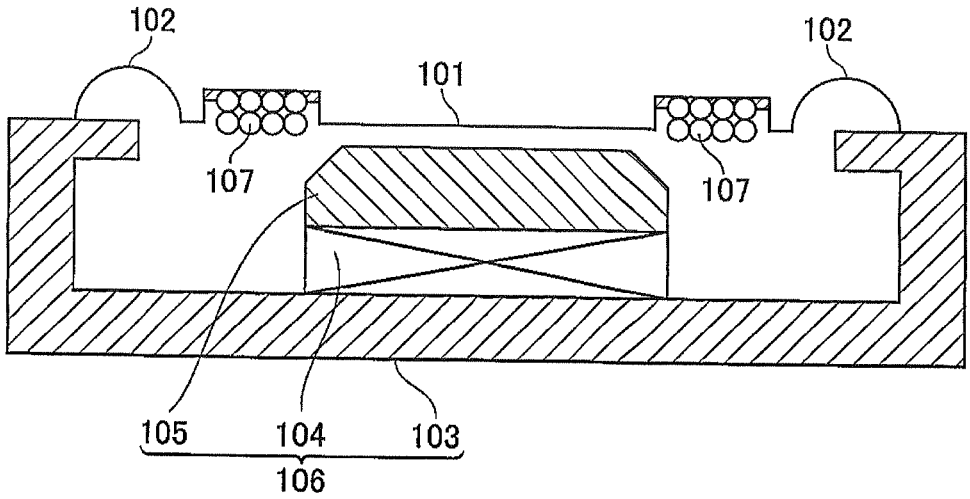
FIG.1 (a) Prior Art
FIG. 1(*a*) is a sectional view illustrating a speaker having a conventional inner-magnet-type magnetic circuit.
Figure 1:
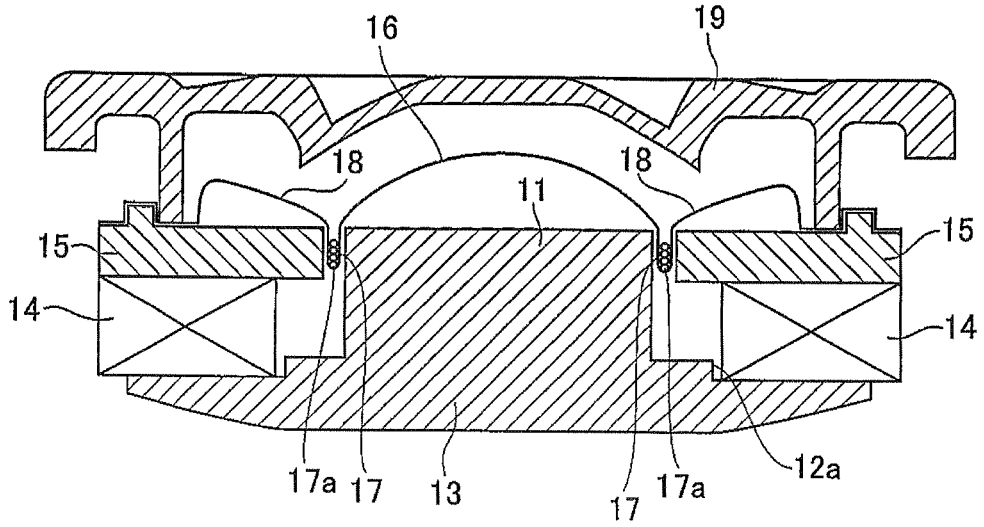
FIG.1 (b) Prior Art

A speaker related to an embodiment of the present invention includes an inner or outer-magnet-type magnetic circuit, a voice coil, and a diaphragm. The inner or outer-magnet-type magnetic circuit includes a magnet, a plate disposed on one pole side of the magnet and a yoke disposed on the other pole side of the magnet. The voice coil is disposed close to the end of the plate in the magnetic circuit. The diaphragm supports the voice coil in place close to the end of the plate while allowing the voice coil to vibrate. The yoke is formed in an approximately flat plate shape having a diameter equal to or larger than that of the plate. The constructional elements of the magnetic circuit may consist of only the magnet and the yoke. In this case, a speaker includes a magnetic circuit equipped with a magnet and a yoke disposed on one pole side of the magnet, a voice coil disposed close to the end of the magnet, and a diaphragm supporting the voice coil in place close to the end of the magnet while allowing the voice coil to vibrate, in which the yoke is formed in an approximately flat plate shape.

In the speaker according to the embodiment of the present invention, the space of the magnetic circuit in which the voice coil is disposed is not defined between the ends of the respective constructional elements of the magnetic circuit (any of the magnet, the yoke and the plate), but is formed as a space opening out from the end of one constructional element. Specifically, the space of the magnetic circuit in which the voice coil is placed is defined by the end of one of the constructional elements of the magnetic circuit and the upper face of the yoke which does not face the end concerned. In order to form such space, the yoke is formed in an approximately flat plate shape. The approximately flat plate shape referred to here may include a bent portion and/or a uneven portion as formed through simple press work, and is therefore not limited to a completely flat plate.

The speaker of the aforementioned structure has the yoke of the magnetic circuit formed in an approximately flat plate shape. Accordingly, it is possible to provide a high performance speaker provided with a magnetic circuit of a simple structure without involving a complicated shaping process.

Further, because the magnetic space of the magnetic circuit in which the voice coil is disposed is designed as an open space, the heat generated from the voice coil can be effectively dissipated.

Still further, because such an arrangement of the voice coil has spatial room, the support structure for the voice coil can be diversified, which in turn makes it possible to design the shape of the voice coil bobbin and/or the diaphragm to facilitate the shaping operation. In particular, in the case that the voice coil bobbin serving as a voice-coil supporter is formed integrally with the diaphragm, there is no necessity to provide a narrow and deep groove for inserting the voice coil bobbin into the narrow magnetic gap, resulting in a simple and easy shaping operation process.

In addition, as compared with a conventional voice coil disposed in a narrow magnetic gap, a high dimensional accuracy is not required for the structural components of the speaker. Accordingly, defectives little occur in the manufacturing operation, resulting in the reduction of manufacturing costs.

Speakers according to an embodiment of the present invention will be described below with reference to the drawings.

[First Embodiment]

Figure 2:
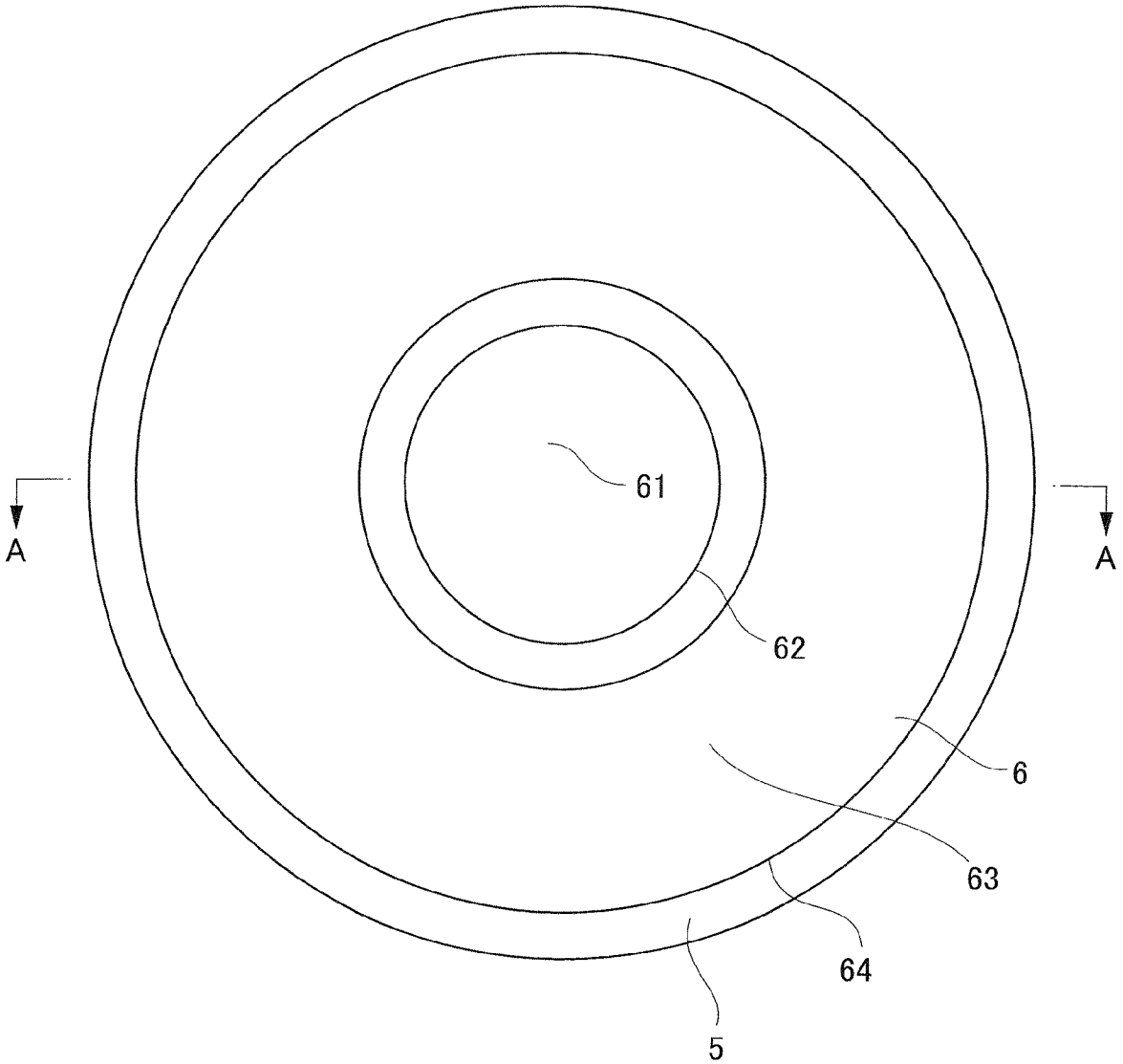
FIG. 2 is a front view illustrating a speaker 100 according to a first embodiment of the present invention.
Figure 3:
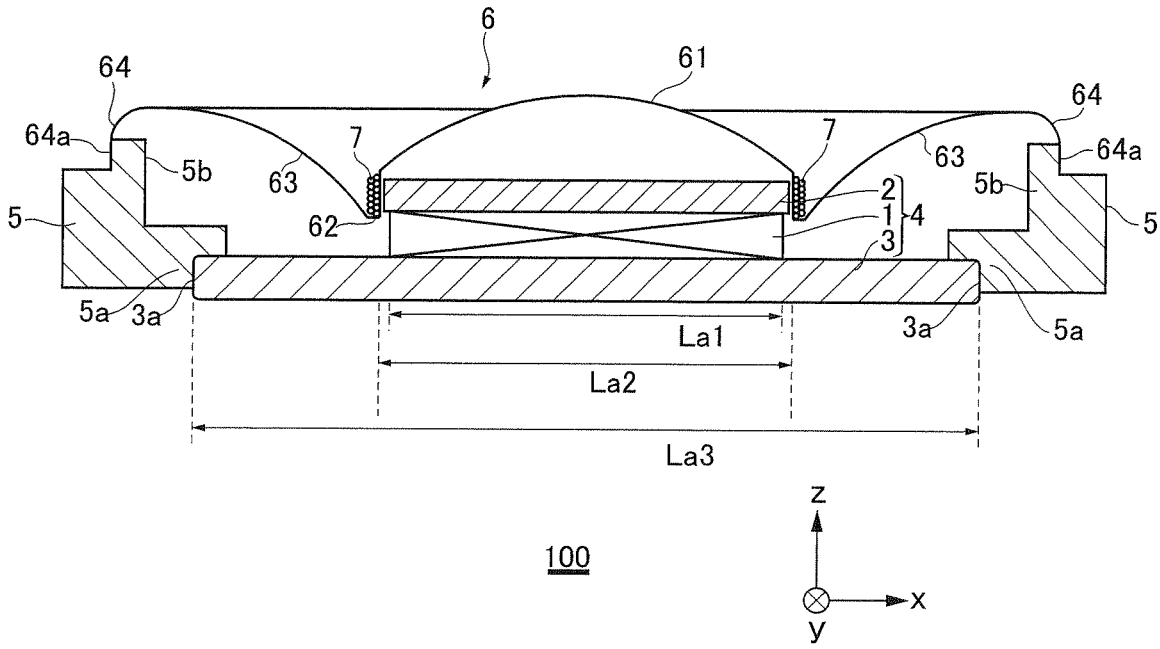
FIG. 3 is a sectional view taken along the A-A line of the speaker 100 in FIG. 2.

FIG. 2 is a front view illustrating a speaker 100 according to a first embodiment of the present invention. FIG. 3 is a sectional view of the speaker 100 taken along the A-A line in FIG. 2.

As illustrated in FIG. 2 and FIG. 3, the speaker 100 according to the first embodiment has a magnet 1, plate 2, yoke 3, magnetic circuit 4, speaker frame (also referred to as "frame") 5, diaphragm 6 and a voice coil 7.

The magnet 1 is formed of a permanent magnet such as of the neodymium system, the samarium-cobalt system, the alnico system, and the ferrite system, for example. The plate 2 is disposed on one pole (on the upper end face) of the magnet 1. The approximately flat-plate-shaped yoke 3 is disposed on the other pole (on the lower end face) of the magnet 1. The magnet 1, the plate 2 and the yoke 3 form an inner-magnet-type magnetic circuit 4. The plate 2 has a diameter La2 larger than the diameter La1 of the magnet 1. The yoke 3 is shaped with a diameter equal to or larger than that of the plate 2. As shown in FIG. 3, for example, the flat-plate-shaped yoke 3 has a diameter La3 equal to or larger than that of the plate 2.

The flat-plate-shaped yoke 3 according to the first embodiment is shaped with the diameter La3 about twice as large as the diameter La2 of the plate 2. The diameter La1 of the magnet 1, the diameter La2 of the plate 2 and the diameter La3 of the yoke 3 are determined as appropriate based on the thickness and the magnitude of the magnetic force of the magnet 1, the magnetic-flux distribution between the plate 2 and the yoke 3, the shape and size of the diaphragm 6, the magnetic characteristics and the operation characteristics of the voice coil 7, and the like. The frame 5 has an engagement step 5*a* formed on the inner peripheral side engaging with the end portion of the yoke 3, and an engagement step 5*b* formed on the outer peripheral side engaging with the end portion of the diaphragm 6.

The diaphragm 6 has a dome-shaped vibrating section 61, a voice coil bobbin (voice coil supporter) 62, a cone-shaped vibrating section 63 and an outer rim 64. The dome-shaped vibrating section 61 corresponds to an embodiment of a first vibrating section in the present invention. The voice coil bobbin 62 corresponds to an embodiment of a voice coil bobbin in the present invention. Then, the cone-shaped vibrating section 63 corresponds to an embodiment of a second vibrating section in the present invention.

As illustrated in FIG. 2 and FIG. 3, the diaphragm 6 according to the first embodiment is formed by integrally molding together the dome-shaped vibrating section 61, the voice coil bobbin (voice coil supporter) 62, the cone-shaped vibrating section 63 and the outer rim 64. The diaphragm 6 is formed of, for example, metallic materials, polymeric materials such as thermoplastic resin or thermosetting resin, or fiber materials such as paper. Examples of the metal materials which can be employed include aluminum, titanium, duralumin, beryllium and a magnesium alloy. Examples of the thermoplastic resin which can be employed include a polypropylene resin, polyethylene, polystyrene, polyethylene terephthalate, and poly methyl methacrylate. As the thermosetting resin, for example, an epoxy resin can be employed.

The dome-shaped vibrating section 61 is formed in a convex shape in a central portion of the diaphragm 6. For the dome-shaped vibrating section 61, various shapes can be employed, such as a radial curve shape, a hemispherical dome shape, a cone shape, and a cascade curve shape. The dome-shaped vibrating section 61 according to the first embodiment is formed in a radial curve shape as shown in FIG. 3. For example, the dome-shaped vibrating section 61 has a central portion rising above the level of the outer rim 64. This shape can offer characteristics of wider directivity. The dome-shaped vibrating section 61 is supported in a specified position above the plate 2 in such a manner as to be caused to vibrate in the z axis direction (operation direction) by the voice coil bobbin 62, the cone-shaped vibrating section 63, and the outer rim 64. As illustrated in FIG. 3, the right-left direction in FIG. 3 corresponds to the x axis direction, the up-down direction in FIG. 3 corresponds to the z axis direction, and a direction at right angles to the x axis direction and the z axis direction corresponds to the y axis direction.

Figure 4:
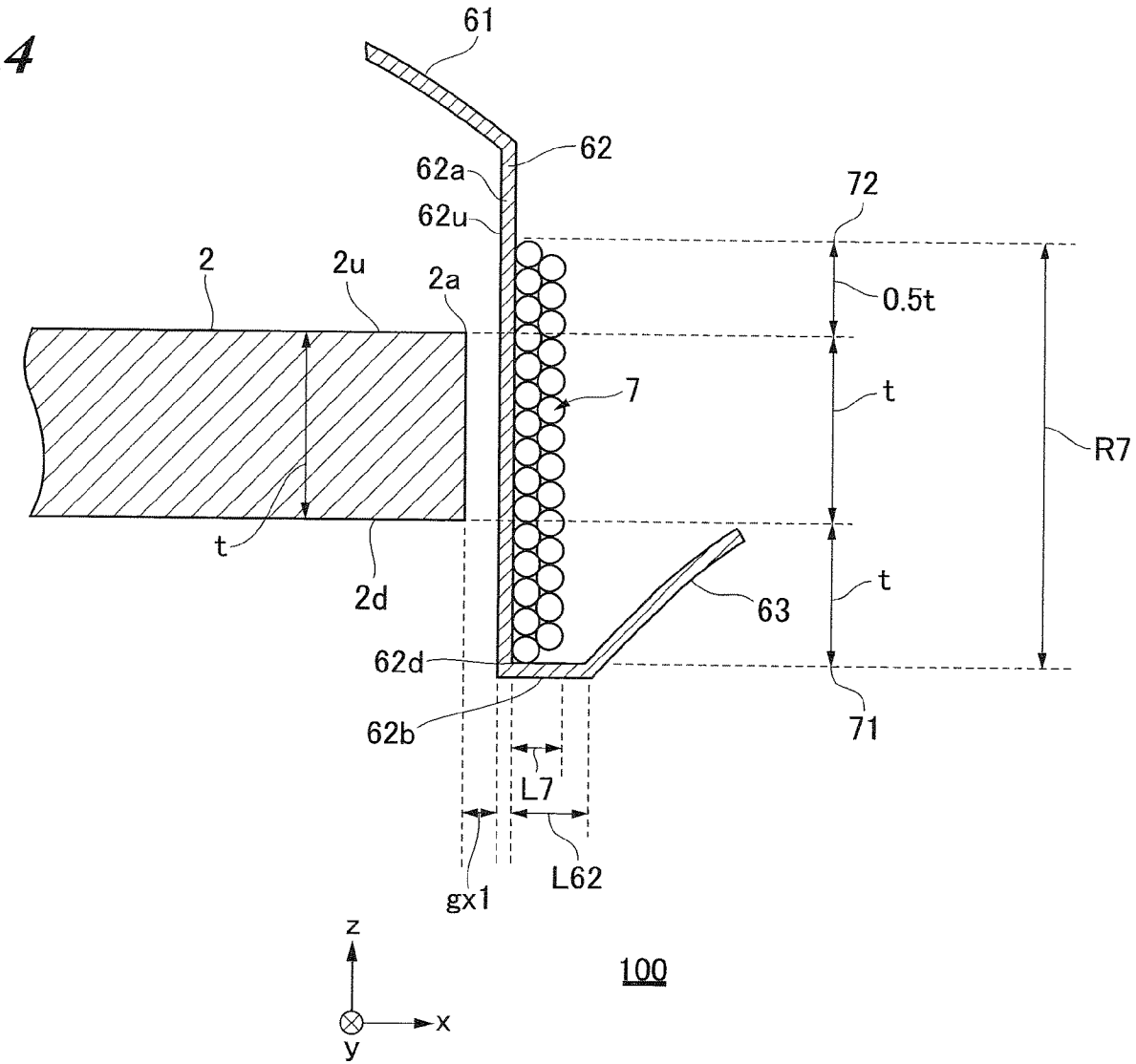
FIG. 4 is an enlarged view of the portion of the speaker 100 around a voice coil bobbin 62 in FIG. 3.

FIG. 4 is an enlarged view of a portion of the speaker 100 in FIG. 3 consisting of the voice coil bobbin 62 and the area around it. The voice coil bobbin 62 is disposed between the central portion of the diaphragm 6 and the outer peripheral rim 64, and serves as a voice coil supporter with an approximately L-shaped cross section in the example shown in FIG. 4. The voice coil bobbin 62 is not limited to an approximately L shaped in a cross section thereof as long as it has a tubular portion 62*a* and a bent portion 62*b*. For example, the bent portion 62*b* extending directly from the lower end of the tubular portion 62*a* may have a recessed-curved face. The tubular portion 62*a* extends in the vibrating direction (z axis direction) as illustrated in FIG. 4, for example. The tubular portion 62*a* is supported by the dome-shaped vibrating section 61, the cone shaped vibrating section 63 and the outer rim 64 in such a manner as to be located in a specified position at a distance gx1 away from the end portion 2*a* of the plate 2. The bent portion 62*b* is bent outward from the lower end of the tubular portion 62*a* as shown in FIG. 4. The length L62 of the bent portion 62*b* is set as approximately equal to or longer than the thickness L7 of the voice coil 7. In the first embodiment, the length L62 is set at about twice the thickness L7.

For example, a pre-formed circular voice coil 7 is inserted into the recess defined by the voice coil bobbin 62 and the cone-shaped vibrating section 63. Then, an ultraviolet (UV) curing agent or the like is injected into the recess, and then UV or the like is applied to fix the voice coil 7. In this case, a portion of the voice coil 7 to which the UV is not applied can be also fixed when a two liquid UV curing agent, an anaerobic UV curing agent or the like is used as the UV curing agent. As described above, the length L62 of the bent portion 62*b* is set at approximately equal to or longer than the thickness L7 of the voice coil 7, which facilitates the fitting of the voice coil 7 onto the voice coil bobbin 62.

Specifically, as illustrated in FIG. 4, the voice coil 7 is mounted in an area R7 of the outer peripheral face of the tubular portion 62*a*. The area R7 is determined in a range from a lower-end position 71 to an upper-end position 72. The lower-end position 71 according to the first embodiment corresponds to a position at a distance t away from the lower end portion 2*d* of the plate 2 in the downward direction. The upper-end position 72 corresponds to a position at a distance 0.5 t away from the upper end portion 2*u* of the plate 2 in the upward direction. In this case, the distance t is a distance corresponding to the thickness t of the plate 2

The placement of the voice coil 7 in the area R7 as described above makes it possible to keep the voice coil 7 in place within a range of an approximately uniform magnetic flux distribution between the plate 2 and the yoke 3 even when the diaphragm 6 vibrates with maximum amplitude. For this reason, a speaker 100 with acoustic characteristics having little distortion can be achieved.

Figure 5:
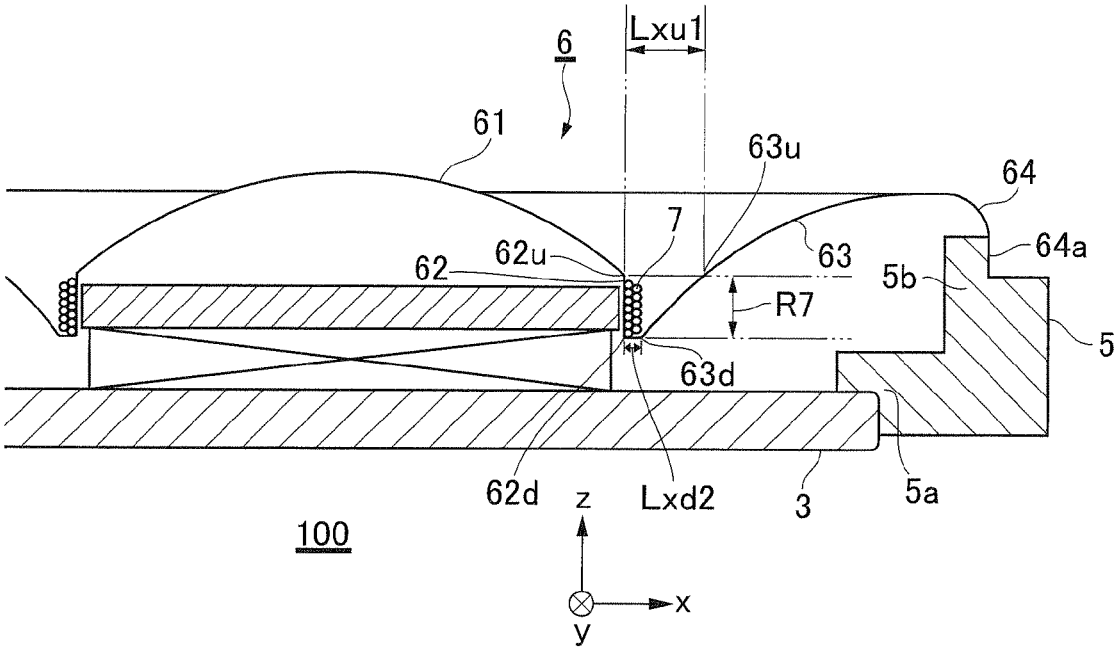
FIG. 5(*a*) is a view illustrating a cone-shaped vibrating section 63 of the speaker 100 shown in FIG. 3.
Figure 5:
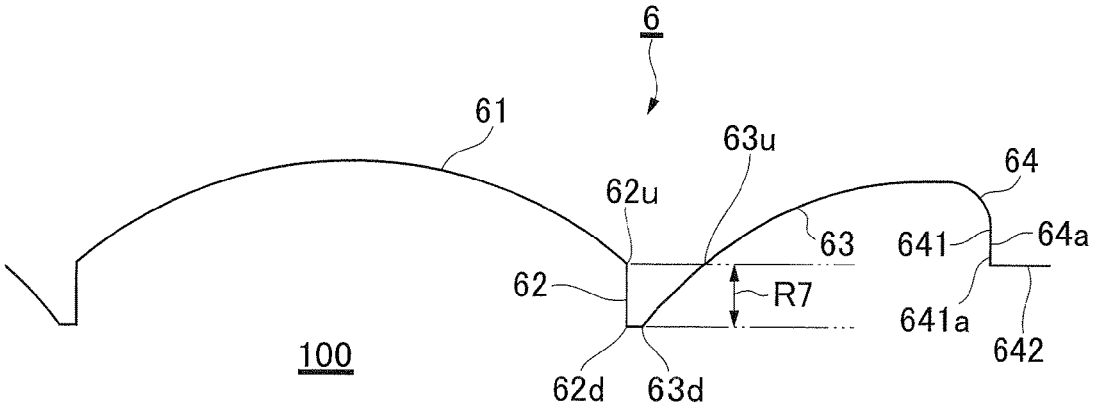

FIG. 5(*a*) is a view illustrating the cone-shaped vibrating section 63 of the speaker 100 shown in FIG. 3. FIG. 5(*b*) is a sectional view of the diaphragm 6 shown in FIG. 5(*a*). For example, as shown in FIG. 5(*b*), the cone-shaped vibrating section 63 extends from the lower end portion of the voice coil bobbin 62 toward the outer rim 64 of the diaphragm 6. The cone-shaped vibrating section 63 has a generating line with a cross-sectional profile of an approximately circular cone shape (cone shape). For the shape of the cone-shaped vibrating section 63, various modifications can be employed, for example, a curved cone shape with an arc-shaped generating line of a cross-sectional profile, a flat cone shape with a linear shaped generating line, and a parabolic cone shape with a radia-patterned generating line.

For example, as illustrated in FIG. 1(*b*), a conventional speaker requires the formation of a narrow-U-shaped cross sectional voice coil bobbin 17 in the narrow magnetic gap. This narrow-U-shaped cross sectional voice coil bobbin 17 can not be easily formed. By contrast, the speaker 100 according to the first embodiment has a magnetic gap between the end portion of the plate 2 and the yoke 3 formed wider than that of the above conventional speaker. This makes it possible to increase the width of the open end of the magnetic gap as compared with the width of the bottom of the recess as defined by the voice coil bobbin 62 and the cone-shaped vibrating section 63, resulting in an easy formation process of the voice coil bobbin.

Specifically, as shown in FIG. 5, the width of the open end is determined as the distance Lxu1 between the upper end portion 62*u* of the voice coil mounting area R7 on the voice coil bobbin 62 and the position 63*u* at the point where the horizontal plane (x-y plane) passing through the upper end portion 62*u* intersects with the cone-shaped vibrating section 63. Then, the width of the bottom is determined as the distance Lxd1 between the lower end portion 62*d* of the voice coil mounting area R7 on the voice coil bobbin 62 and the position 63*d* at the intersection of the horizontal plane (x-y plane) passing through the lower end portion 62*d* with the cone-shaped vibrating section 63. The open-end width Lxu1 is wider than the bottom width Lxd2. The open-end width Lxu1 is preferably approximately equal to the length of the voice coil mounting area R7.

In the diaphragm 6 of the aforementioned structure, the recess formed by the voice coil bobbin 62 and the cone-shaped vibrating section 63 is designed to increase in width from the bottom of the recess toward the upper open end. As a result, it is possible to readily form the diaphragm 6 as compared with a diaphragm comprising a U-shaped cross-sectional voice coil bobbin as illustrated in FIG. 1(*b*).

The outer rim 64 has a fitting element 64*a* engaging with the engagement step 5*b* of the frame 5 as shown in FIG. 5. The fitting element 64*a* has a tubular portion 641 bending toward the rear in the z direction, and an end portion 642 bending at the lower end of the tubular portion 641 outward in the x direction. When an inner peripheral face 641*a* of the tubular portion 641 and the engagement step 5*b* of the frame 5 are fit with each other, the diaphragm 6 can be positioned with respect to the magnetic circuit 4 and the frame 5. For this purpose, the engagement step 5*b* of the frame 5 is shaped in correspondence with the inner peripheral face 641*a* of the tubular portion 641.

The speaker 100 of the foregoing structure is assembled as follows. First, as shown in FIG. 2 to FIG. 5, the plate 2 is placed on one pole side of the magnet 1, and then the flat-plate-shaped yoke 3 is placed on the other pole side of the magnet 1. In this arrangement, the respective central axes of the magnet 1, the plate 2 and the yoke 3, which have a circular shape, respectively, are aligned with each other. The yoke 3 is molded integrally with the frame 5 by use of a manufacturing apparatus, for example, an injection molding equipment. The diaphragm 6 having the dome-shaped vibrating section 61, the voice coil bobbin 62, the cone-shaped vibrating section 63 and the outer rim 64 is molded in one piece by use of a manufacturing apparatus such as a presswork apparatus or an injection molding equipment.

Then, the voice coil 7 which has been shaped in a circular form in advance is placed in a recess defined by the voice coil bobbin 62 and the cone-shaped vibrating section 63, and then is fixed to the voice coil bobbin 62 by use of an adhesive or the like. The voice coil 7 may be provided in a predetermined position by winding an electric-conductor wire onto the voice coil bobbin 62. Then, the inner peripheral face 641*a* of the tubular portion 641 and the engagement step 5*b* of the frame 5 are fit with each other to position the diaphragm 6 relative to the magnetic circuit 4 and the frame 5. After this positioning, the diaphragm 6 and the frame 5 are joined together by use of an adhesive or the like to form the speaker 100.

In the speaker 100 of the foregoing structure, the diaphragm 6 supports the voice coil 7 at a specified position within the magnetic-flux distribution generated by the magnet 1, the plate 2 and the yoke 3. Accordingly, when an audio signal is applied to the voice coil 7 from an input terminal (not shown) through a lead, an electromagnetic force is generated on the voice coil 7 in accordance with the audio signal. The electromagnetic force results in a drive force causing the diaphragm 6 to vibrate in the z axis direction. Specifically, the voice coil bobbin 62 mounted with the voice coil 7 is vibrated in the z axis direction by the drive force so as to vibrate the dome-shaped vibrating section 61 and the cone-shaped vibrating section 63. Since the speaker 100 radiates a compressional wave by the vibration of the dome-shaped vibrating section 61 and the cone-shaped vibrating section 63, the speaker 100 has a combination of the characteristics of a typical dome speaker and a typical cone speaker.

As described above, the speaker 100 according to the first embodiment has an inner-magnet-type magnetic circuit 4 made up of a magnet 1, a plate 2 disposed on one pole of the magnet 1 and a yoke 3 disposed on the other pole of the magnet 1; a voice coil 7 disposed around an end portion of the plate 2 in the magnetic circuit 4; and a diaphragm 6 supporting the voice coil 7 in place around the end portion of the plate 2 while allowing the voice coil to vibrate. The yoke 3 is formed in an approximately flat plate shape having a diameter equal to or larger than that of the plate. As a result, it is possible to provide a magnetic circuit 4 of a simple structure achieved without a complicated process for shaping the yoke as in the conventional way. Thus, it is also possible to provide a speaker 100 employing such a magnetic circuit 4.

In addition, the diaphragm 6 has a dome-shaped vibrating section (first vibrating section) 61 formed in a central portion of the diaphragm 6, a cone-shaped vibrating section (second vibrating section) 63 having the outer periphery directly or indirectly supported by the speaker frame 5, and a voice coil bobbin 62 formed between the dome-shaped vibrating section 61 and the cone-shaped vibrating section 63 and mounted with the voice coil 7. Since the dome-shaped vibrating section 61, the cone-shaped vibrating section 63 and the voice coil bobbin 62 are formed together in one piece by use of, for example, press-forming techniques or injection molding techniques, the diaphragm 6 can be readily fabricated.

The voice coil bobbin 62 has a L-shaped cross section bending in the outward direction from the end of the tubular portion 62*a* on which the voice coil 7 is mounted. In the recess created by the voice coil bobbin 62 and the cone-shaped vibrating section 63, the width of the open end of the recess is larger than that of the bottom of the recess. In consequence, the voice coil bobbin 62 can be readily shaped as compared with the case of the U-shaped cross-sectional voice coil bobbin 62 as illustrated in FIG. 1(*b*).

The diaphragm 6 has the fitting element 64*a* provided at the end portion of the diaphragm 6 for engagement with the engagement step (fitted element) 5*a* formed in the frame 5. Since the positioning between the diaphragm 6 and the speaker frame 5 can be achieved by ensuring the engagement between the fitting element 64*a* of the diaphragm 6 and the engagement step 5*a* of the frame 5, it is possible to readily ensure the alignment between the diaphragm 6 and the frame 5. Specifically, the diaphragm 6 has the end portion formed in a tubular shape, and the inner side face of the tubular shape is fixed to the outer side face of the engagement step 5*b* which is formed in the speaker frame 5.

In this stage, because the dome-shaped vibrating section 61, the voice coil bobbin 62, the cone-shaped vibrating section 63, and the cone-shaped vibrating section 63 are molded together in one piece, it is possible to position the structural elements with one another in the respective specified positions with high accuracy. In particular, the above-described structure makes it possible to accurately locate the voice coil bobbin 62 in a pre-specified position close to the end portion of the plate 2 in a simple mounting process.

In addition, because the inner side face of the end portion of the diaphragm 6 is joined to the outer side face of the engagement step 5*b* formed in the speaker frame 5, the effective vibration area can be increased, resulting in an increase in sound pressure.

The voice coil 7 can be readily mounted on the voice coil bobbin 62 through the process of fixing the voice coil 7 onto the side face of the L-shaped cross-section portion of the voice coil bobbin 62 by use of an adhesive.

[Second Embodiment]

Figure 6:
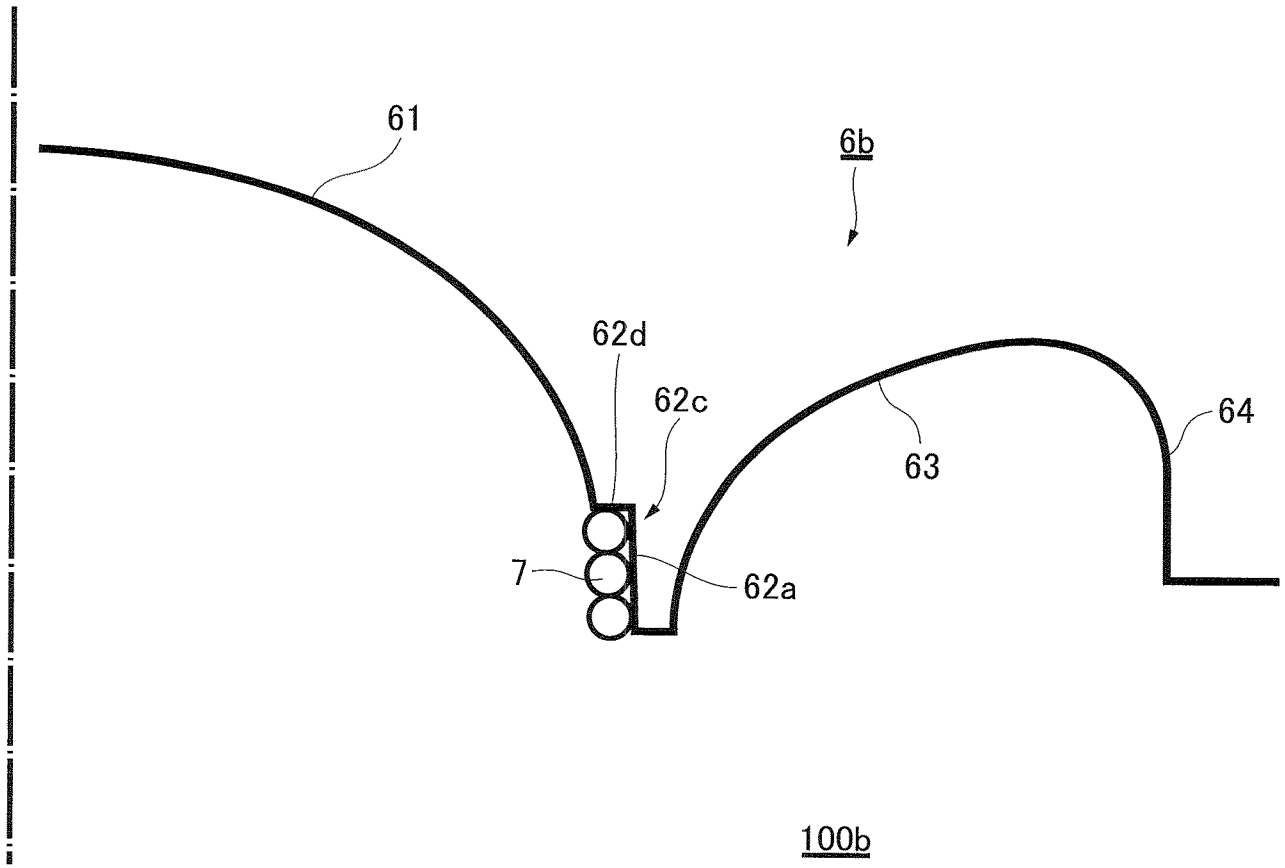
FIG. 6 is a diagram illustrating a speaker 100*b* according to a second embodiment of the present invention, which is a sectional view of the diaphragm 6*b*.

FIG. 6 is a diagram illustrating a speaker 100*b* according to a second embodiment of the present invention, which is a sectional view of a diaphragm 6*b*. In FIG. 6, a portion of the diaphragm 6*b* extending from a central portion to an end portion thereof is enlarged. The speaker 100*b* according to the second embodiment has a diaphragm 6*b* as shown in FIG. 6. The diaphragm 6*b* according to the second embodiment has a voice coil 7 mounted on the rear side (center facing side) of a voice coil bobbin 62*c*.

As illustrated in FIG. 6, for example, the diaphragm 6*b* according to the second embodiment has a bent portion 62*d* formed between the dome-shaped vibrating section 61 and the voice coil bobbin 62*c* and bending from the upper end portion of a tubular portion 62*a* in the inward direction. The size of the bent portion 62*d* is set to be approximately equal to the diameter of the ring-shaped voice coil 7.

In the speaker 100*b* of the foregoing structure, the voice coil 7 is disposed on the rear side of the voice coil bobbin 62. For this reason, the voice coil 7 can be supported in a position closer to the end portion of the plate 2 than the case of the first embodiment. In consequence, the magnetic flux density is enhanced, resulting in a speaker with a high sensitivity to an input signal applied to the voice coil 7.

Because the voice coil 7 is mounted on the reverse face of the diaphragm 6, the voice coil 7 is not visually recognized from the front side of the speaker. Thus, this improves the design property of the speaker 10*b*.

[Third Embodiment]

Figure 7:
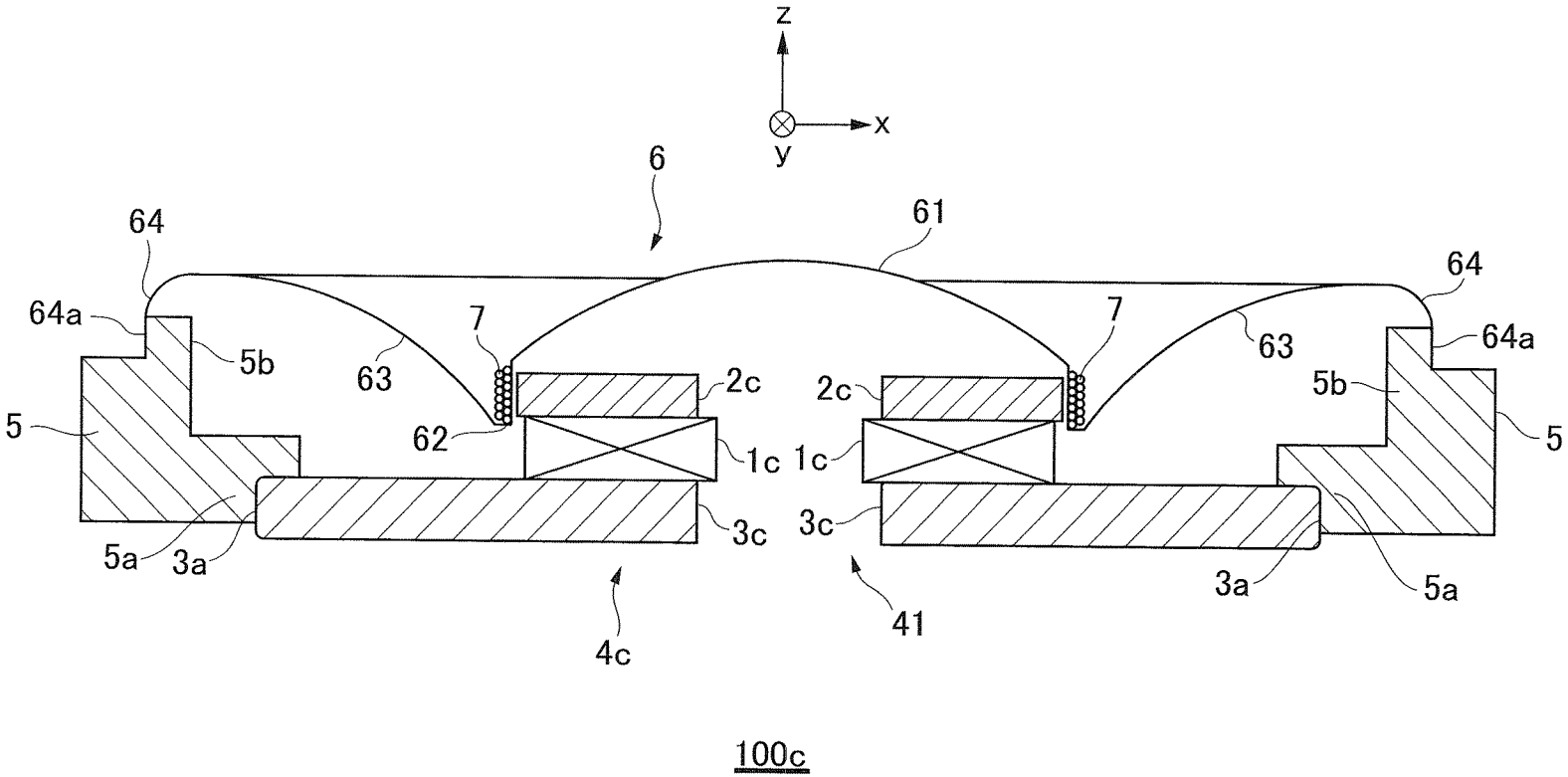
FIG. 7 is a sectional view illustrating a speaker 100*c* according to a third embodiment of the present invention.

FIG. 7 is a sectional view illustrating a speaker 100*c* according to a third embodiment of the present invention. The description of the components common to this embodiment and the first and second embodiments is partially omitted.

As illustrated in FIG. 7, a speaker 100*c* according to the third embodiment has a magnetic circuit 4*c*. The magnetic circuit 4*c* has a through hole 41 formed in the axis direction (z axis direction, i.e., up-down direction in the drawing). Specifically, in the magnetic circuit 4*c*, as shown in FIG. 7, the through hole 41 is formed inside a magnet 1*c*, a plate 2*c* and a yoke 3*c* in the axis direction.

In the speaker 100*c* of the above-described structure, when the dome-shaped vibrating section 61 vibrates in the axis direction, the air in the dome-shaped vibrating section 61 flows out through the through hole 41, or alternatively the air outside flows into the dome-shaped vibrating section 61 through the through hole 41. For this reason, the acoustic characteristics of the speaker 100*c* according to the third embodiment are improved as compared with the case of the second embodiment. In addition, the weight of the speaker can be reduced. Furthermore, an improvement in operating point of the magnetic circuit can be achieved.

[Fourth Embodiment]

Figure 8:
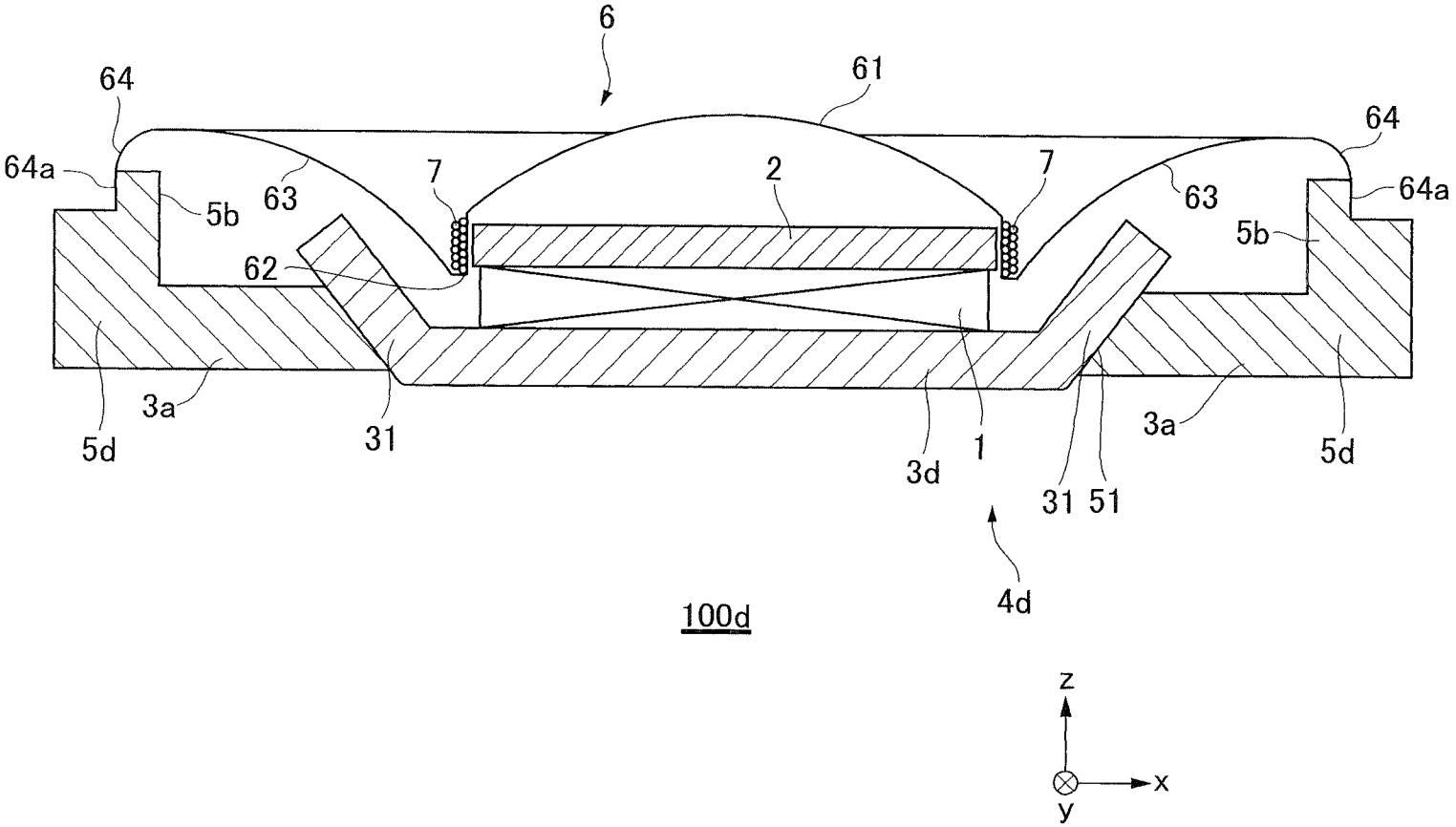
FIG. 8 is a sectional view illustrating a speaker 100*d* according to a fourth embodiment of the present invention.

FIG. 8 is a sectional view illustrating a speaker 100*d* according to a fourth embodiment of the present invention. The description of the components common to this embodiment and the first to third embodiments is partially omitted. As shown in FIG. 8, the speaker 100*d* according to the fourth embodiment has a magnet 1, plate 2, yoke 3*d*, magnetic circuit 4*d*, frame 5*d*, diaphragm 6 and a voice coil 7. The magnet 1, the plate 2 and the yoke 3*d* form the magnetic circuit 4*d*.

The yoke 3 is formed in an approximately flat plate shape. An end portion 31 thereof is formed in a shape bending toward the plate 2. The yoke 3*d* is shaped in a so-called dish form. Specifically, the end portion 31 of the yoke 3*d* is formed in a conical shape bending up from the horizontal plane at an angle ranging from about 40 degrees to about 70 degrees. The angle is determined as appropriate in accordance with the angle of the conically inclined face of the cone-shaped vibrating section 63 of the diaphragm 6, the magnetic flux density distribution between the plate 2 and the yoke 3, and the like.

The frame 5*d* has an inner periphery 51 joined to the rear face of the end portion 31 of the above-described dish-shaped yoke 3*d*. The frame 5*d* is preferably fit to the dish-shaped yoke 3*d* by use of insert forming techniques. This makes it possible to omit, for example, a process for bonding the frame 5*d* and the yoke 3*d* together with an adhesive, thus achieving a reduction in manufacturing time period. In addition, the manufacturing costs can be reduced.

As described above, in the speaker 100*d* according to the fourth embodiment, the distance between the end portion of the plate 2 and the yoke 3*d* is shorter than that in the case of the first embodiment, thus offering a higher magnetic-flux density. In addition, the magnetic leakage can be reduced as compared with the case of the first embodiment.

[Fifth Embodiment]

Figure 9:
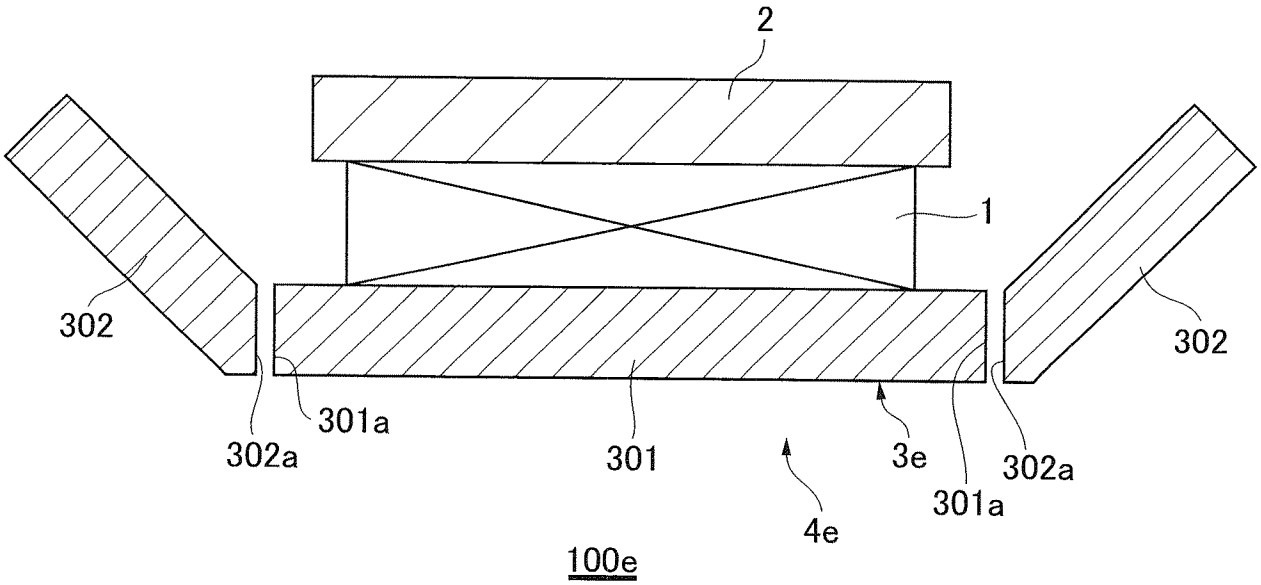
FIG. 9 is a sectional view illustrating a magnetic circuit of a speaker 100*e* according to a fifth embodiment of the present invention.

FIG. 9 is a sectional view illustrating a magnetic circuit of a speaker 100*e* according to a fifth embodiment of the present invention. The description of the components common to this embodiment and the first to fourth embodiments is partially omitted. As shown in FIG. 9, the speaker 10*e* according to the fifth embodiment has a magnetic circuit 4*e*. The magnetic circuit 4*e* has a magnet 1, a plate 2, and a yoke 3*e*.

The yoke 3*e* has a flat-sheet-shaped plate 301 approximately identical in diameter with the plate 2, and a cone-shaped member 302 having an inner peripheral end 302*a* joined to an outer peripheral end 301 of the plate 301. The outer peripheral end 301*a* of the flat-sheet-shaped plate 301 and the inner peripheral end 302*a* of the cone-shaped member 302 are secured to each other with, for example, an adhesive. The cone-shaped member 302 corresponds to the end portion 31 in the fourth embodiment.

The manufacturing process for the magnetic circuit 4*e* will be described below. First, the flat-sheet-shaped plate 301 and the cone-shaped member 302 are formed separately from each other. Then, the outer peripheral end 301*a* of the flat-sheet-shaped plate 301 and the inner peripheral end 302*a* of the cone-shaped member 302 are fixed to each other with an adhesive or the like.

As described above, in the fifth embodiment, the flat-sheet-shaped plate 301 of a simple structure and the cone-shaped member 302 which is a separate member from the plate 301 are combined to form a yoke 3*d* having a shape and functions similar to those in the case of the fourth embodiment. Because of this, a shortening of the manufacturing process and a reduction in manufacturing costs can be realized.

[Sixth Embodiment]

Figure 10:
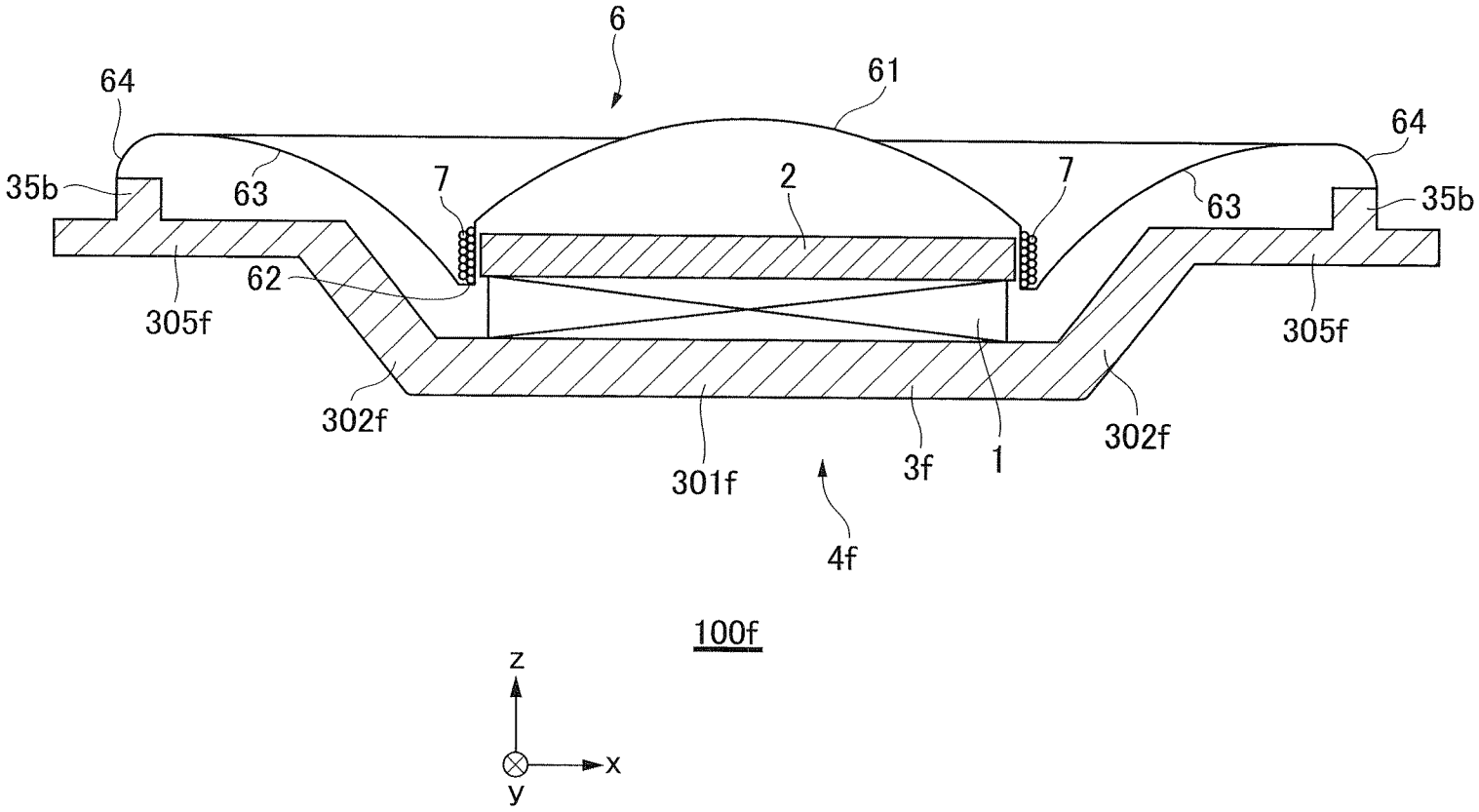
FIG. 10 is a sectional view illustrating a speaker 100*f* according to a sixth embodiment of the present invention.

FIG. 10 is a sectional view illustrating a speaker 100*f* according to a sixth embodiment of the present invention. The description of the components common to this embodiment and the first to fifth embodiments is partially omitted. As shown in FIG. 10, the speaker 100*f* according to the sixth embodiment has a yoke also functioning as a frame. Specifically, the yoke 3*f* according to the sixth embodiment is provided with a flat-plate-shaped portion 301*f* in the central area. The flat-plate-shaped portion 301*f* is disposed on the pole of the reverse face of the magnet 1. A flat-plate-shaped frame portion 305*f* with an engagement step 35*b* is formed in the end area of the yoke 3*f*. The yoke 3*f* has a cone-shaped portion 302*f* formed between the flat-plate-shaped portion 301*f* and the frame portion 305*f*. The conical face of the cone-shaped portion 302*f* is inclined up toward the front side of the speaker. The frame portion 305*f* is approximately level with the plate 2 in the horizontal direction. The engagement step 35*f*, which corresponds to the engagement step 5*f* described earlier, is fit with the end portion of the diaphragm 6.

The flat-plate-shaped portion 301*f*, the cone-shaped portion 302*f* and the frame portion 305*f* are molded together in one piece to form the yoke 3*f*. For example, for molding the yoke 3*f*, various types of manufacturing apparatus can be employed such as a die-molding apparatus, a presswork apparatus, and an injection molding apparatus.

As described above, in the speaker 100*f* according to the sixth embodiment, the yoke 3*f* has a structure as described above, so that the yoke 3*f* has a frame function as well as a yoke function. While, in the speaker according to the fourth embodiment, the yoke and the resin-made frame are formed by use of insert forming techniques, the insert forming process is not required for forming the yoke 3*f* of the present embodiment, and the yoke 3*f* with the aforementioned structure can be readily formed by use of a single material.

[Seventh Embodiment]

Figure 11:
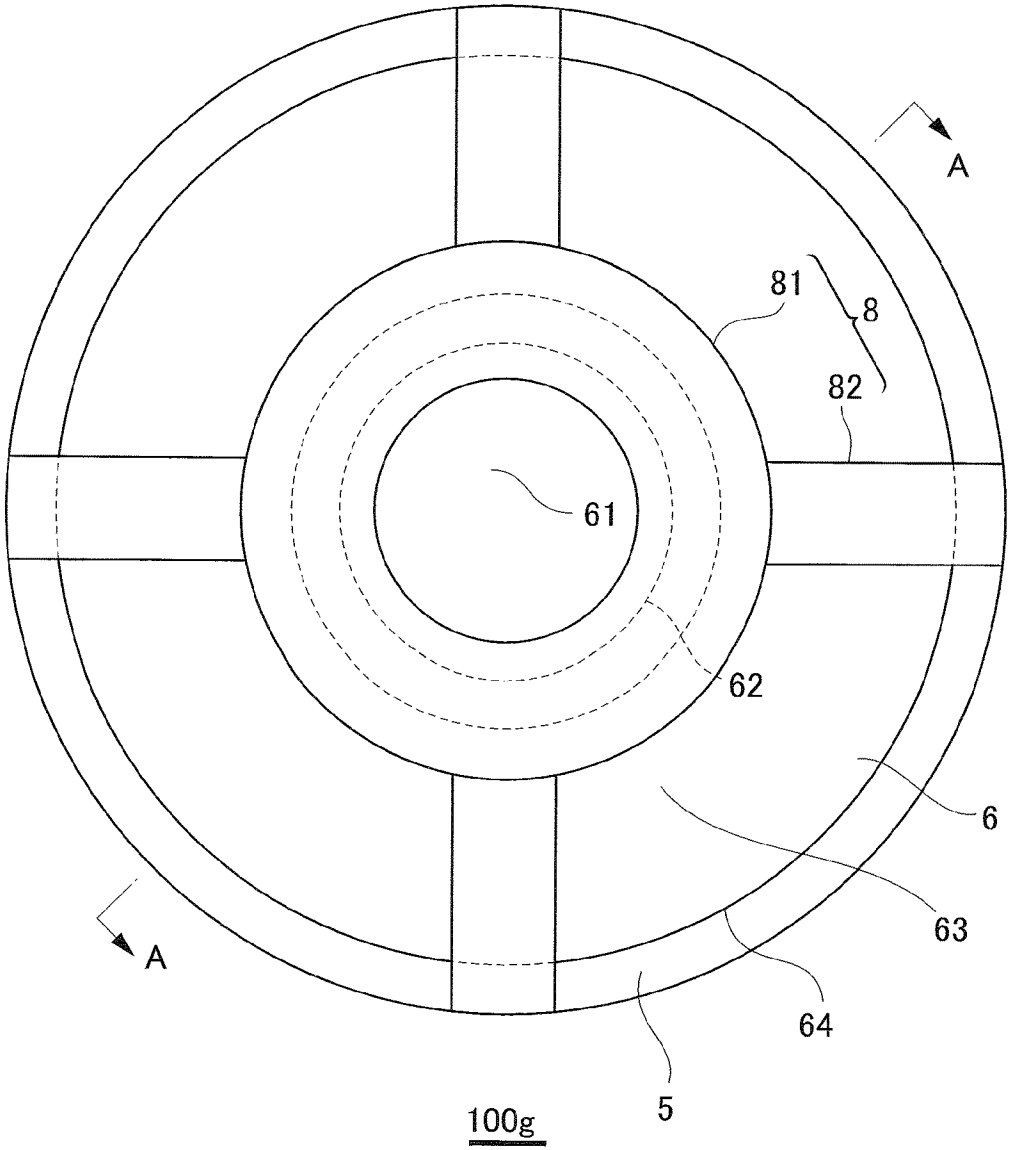
FIG. 11 is a front view illustrating a speaker 100*g* according to a seventh embodiment of the present invention.
Figure 12:
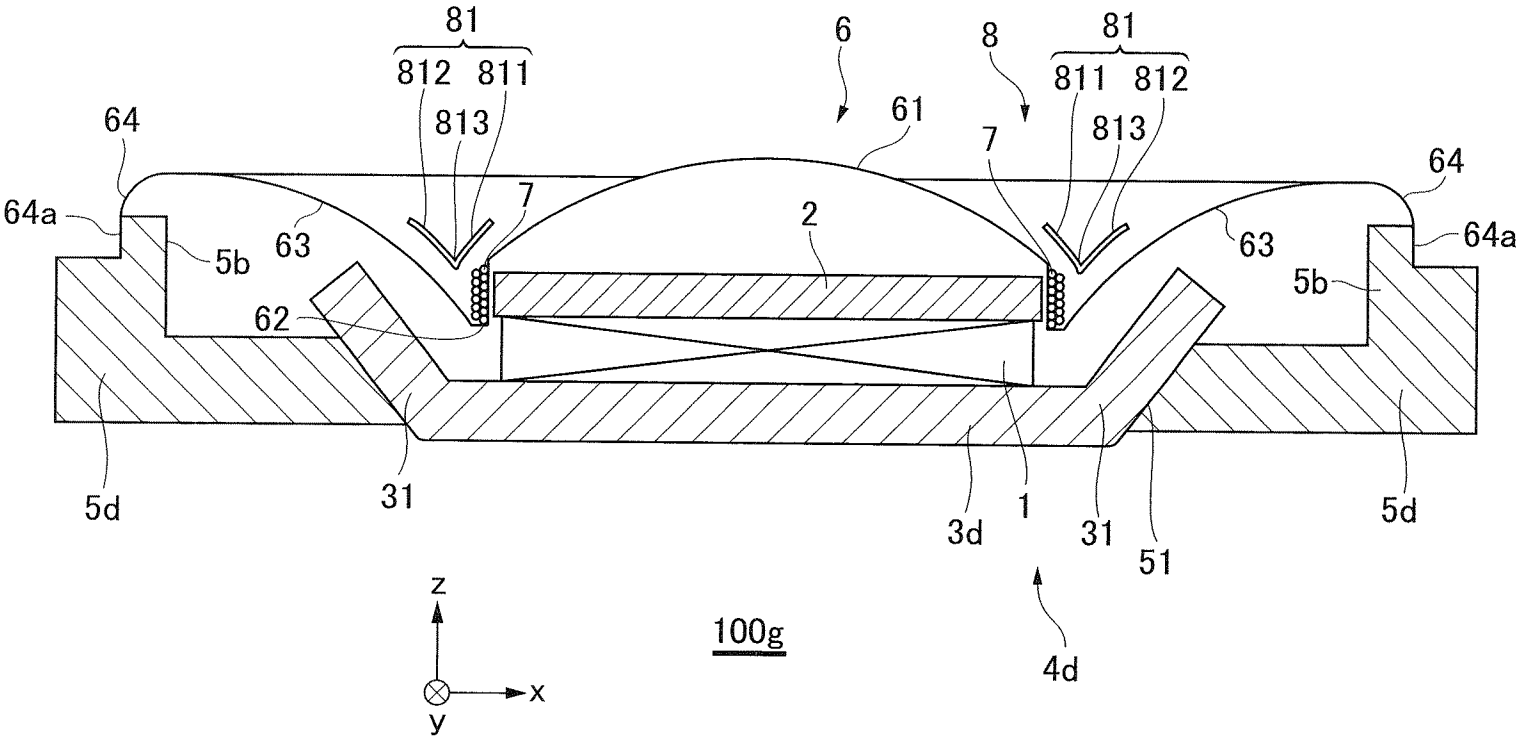
FIG. 12 is a sectional view of the speaker 100*g* taken along the A-A line in FIG. 11.

FIG. 11 is a front view illustrating a speaker 100*g* according to a seventh embodiment of the present invention. FIG. 12 is a sectional view taken along the A-A line of the speaker 100*g* in FIG. 11. The description of the components common to this embodiment and the fourth embodiment is partially omitted. As shown in FIG. 11 and FIG. 12, the speaker 100*g* according to the seventh embodiment has an equalizer 8 provided near the plate 2 and the voice coil 7 on the front side of the diaphragm 6. The equalizer 8 is formed of magnetic materials such as iron. Specifically, one is the equalizer 8 according to the seventh embodiment has two functions: the function of effecting certain changes in speaker directivity, sound pressure, frequency and the like, and the other is the function of improving the characteristics of the magnetic circuit made up of the magnet 1, the plate 2 and the yoke 3*d*.

As shown in FIG. 11, the equalizer 8 has a ring-shaped portion 81 and arm portions 82. The ring-shaped portion 81 is formed in a ring shape placed near the plate and the voice coil 7 above the front face of the diaphragm 6. The diameter of the ring-shaped portion 81 is smaller than the diameter of the yoke 3. The ring-shaped portion 81 has a cross-sectional shape corresponding to the recess created by the voice coil bobbin 62 and the cone-shaped vibrating section 63. The arm portions 82 extend from the outer rim of the ring-shaped portion 81 in a radial pattern, and the outer ends of the respective arm portions 82 are fixed to the frame 5. The arm portions 82 hold the ring-shape portion 81 in the specified place as described above. The ring-shaped portion 81 and the arm portions 82 are molded together in one piece.

As illustrated in FIG. 11, for example, the ring-shaped portion 81 has a first inclined portion 811 and a second inclined portion 812. A bent portion 813 is created between the first inclined portion 811 and the second inclined portion 812. The first inclined portion 811 has a face inclined at a degree almost equal to the inclined angle of the dome-shaped vibrating section 61. The first inclined portion 811 is preferably formed in an arc-shaped cross section corresponding to the cross-sectional shape of the dome-shaped vibrating section 61. The second inclined portion 812 has a face inversely inclined at the same angle as that of the second inclined portion 812, specifically, a face inclined at an angle almost equal to that of the cone-shaped vibrating section 63. The second inclined portion 812 is preferably formed in an arc-shaped cross section corresponding to the cross-sectional shape of the cone-shaped vibrating section 63. The shape of the equalizer 8 is determined as required in accordance with the magnetic flux distributions of directions, magnitudes and the like of the magnetic flux flowing in the magnetic circuit 4*d* made up of the magnet 1, the plate 2 and the yoke 3*d*, the characteristics of an operating point and the like of the magnetic circuit 4*d*.

Because the ring-shaped portion 81 is provided in the vicinity of the boundary between the dome-shaped vibrating section 61 and the cone-shaped vibrating section 63 of the front face of the diaphragm 6, the equalizer 8 structured as described above is capable of dividing the compressional wave emitted by the vibration of the diaphragm 6 into two compressional waves coming from the dome-shaped vibrating section 61 and from the cone-shaped vibrating section 63, thus radiating the divided compressional waves in the forward direction of the speaker. In consequence, certain changes can be effected in the acoustic characteristics of both of the dome-shaped vibrating section 61 and the cone-shaped vibrating section 63, such as those relating to the directivity, the sound pressure, the frequency.

Because the equalizer 8 is formed of magnetic materials such as iron, by determining the shape and the desired materials of the equalizer 8 as required, the magnetic flux distributions of directions, magnitudes and the like of the magnetic flux flowing in the magnetic circuit 4*d* made up of the magnet 1, the plate 2 and the yoke 3*d*, can be set to desired distributions. In addition, the magnetic leakage can be reduced. The characteristics of an operating point and the like of the magnetic circuit 4*d* can be set to desired characteristics. In short, a magnetic circuit with desired characteristics can be provided by the magnet 1, the plate 2, the ring-shaped portion 81 and the yoke 3*d*.

In addition, because the equalizer 8 with the aforementioned structure is disposed such that the voice coil 7 fixed to the voice coil bobbin 62 with an adhesive or the like is not recognized visually from the front side of the speaker, the design property can be improved as compared with conventional speakers.

[Eighth Embodiment]

Figure 13:
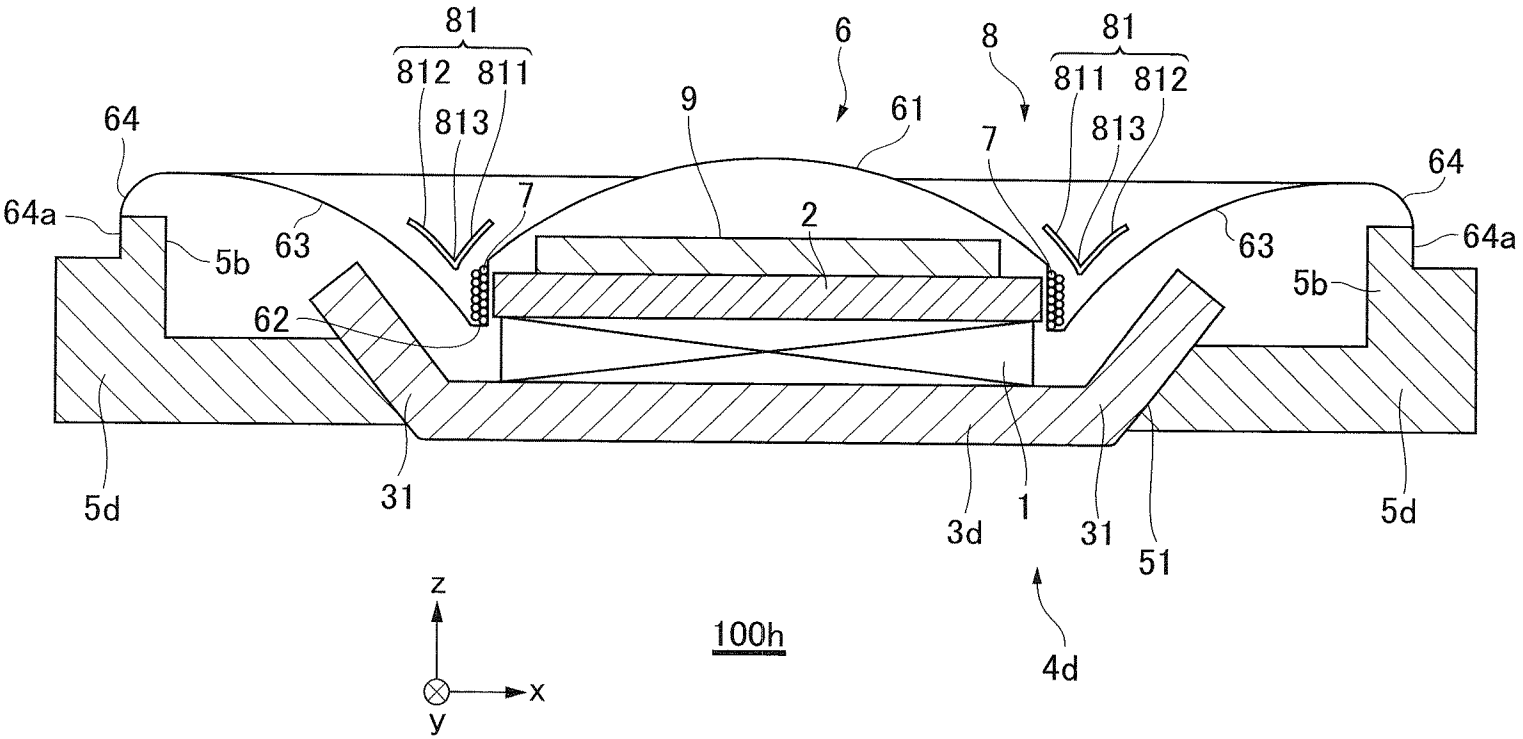
FIG. 13 is a sectional view illustrating a speaker 100*h* according to an eighth embodiment of the present invention.

FIG. 13 is a sectional view illustrating a speaker 100*h* according to an eighth embodiment of the present invention. The description of the components common to this embodiment and the first to seventh embodiments is partially omitted. As shown in FIG. 13, the speaker 100*h* according to the eighth embodiment has a repulsion magnet 9 of a polarity the reverse of that of the magnet 1 and placed on the upper face of the plate 2. For example, as shown in FIG. 13, the repulsion magnet 9 is placed on the upper face of the plate 2, and is magnetized to have a polarity repulsing the polarity of the magnet 1. The repulsion magnet 9 has a diameter smaller than the diameter of the plate 2. Specifically, the repulsion magnet 9 is formed in a shape and a size such that the inner side face of the dome-shaped vibrating section 61 does not come into contact with the repulsion magnet 9 even when the dome-shaped vibrating section 61 of the diaphragm 6 vibrates in the drive direction (z axis direction).

For example, when the repulsion magnet 9 is not provided, the magnetic flux is distributed from the upper face of the magnet 1 through the plate 2 in the z axis direction. On the other hand, when the repulsion magnet 9 is provided on the upper face of the plate 2, the magnetic flux flowing from the upper face of the magnet 1 in the z axis direction is induced in the horizontal direction by the repulsion magnet 9, resulting in a reduction in leaked magnetic flux. The directional properties of the magnetic flux in the end portion of the plate 2 can be improved. In addition, the magnetic flux density in the magnetic gap between the plate 2 and the yoke 3*d* can be increased. Because of an increase in magnetic flux density, the sensitivity of the voice coil 7 can be increased. In addition, because the repulsion magnet 9 and the equalizer 8 form a so-called repulsion magnetic circuit, the magnetic flux leakage from the front side of the speaker can be reduced.

[Ninth Embodiment]

Figure 14:
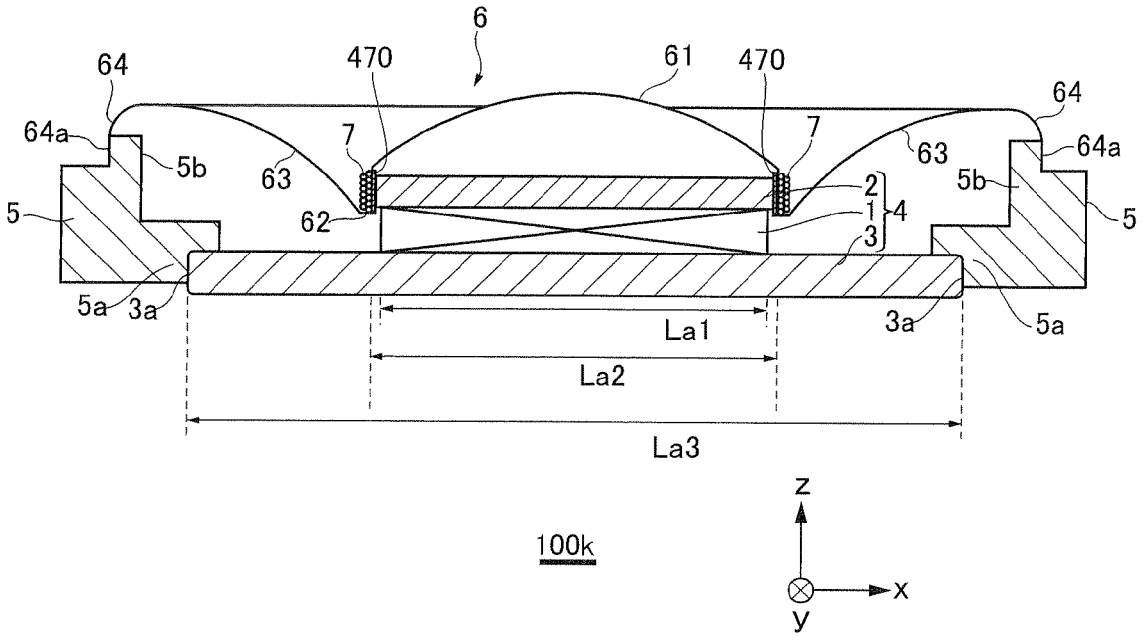
FIG. 14 is a sectional view illustrating a speaker 100*k* according to a ninth embodiment of the present invention.
Figure 15:
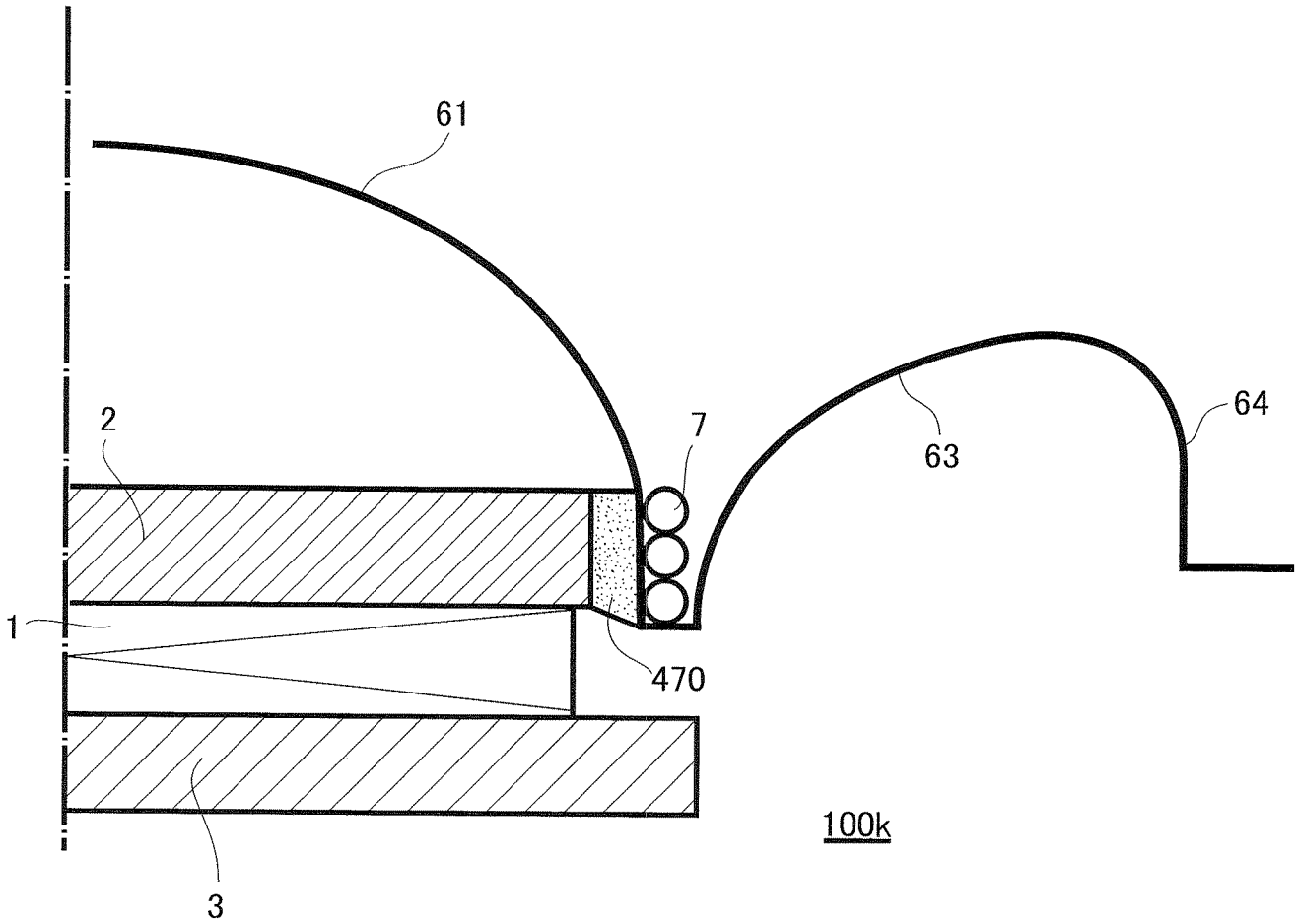
FIG. 15 is an enlarged view of a cross section of the portion of the speaker 100*k* around a voice coil shown in FIG. 14.

FIG. 14 is a sectional view illustrating a speaker 100*k* according to a ninth embodiment of the present invention. FIG. 15 is a sectional enlarged view of a portion of the speaker 100*k* shown in FIG. 14 consisting of the voice coil and the area around it. The description of the components common to this embodiment and the first to eighth embodiments is partially omitted. As shown in FIG. 14 and FIG. 15, in the speaker 100*k* according to the ninth embodiment, a magnetic fluid 470 is held in place between the magnetic circuit 4 and the voice coil 7 either directly or through the diaphragm 6. In the ninth embodiment, as shown in FIG. 14 and FIG. 15, the magnetic fluid 470 is disposed between the plate 2 and the diaphragm 6 having the outer periphery on which the voice coil 7 is mounted.

Specifically, for example, as illustrated in FIGS. 14 and 15, the speaker 100*k* includes a magnetic circuit 4 and a diaphragm 6. In the magnetic circuit 4, the magnet 1 is disposed between the plate 2 and the yoke 3 which are formed in disk shapes differing in diameter. The vibrating portions of the diaphragm 6 are respectively formed inside and outside the voice coil 7 and, for example, the outer periphery of the diaphragm 6 is secured to the speaker frame 5 to perform the positioning process. The magnetic fluid 470 is held (disposed) between the plate 2 and either the diaphragm 6 or the voice coil 7.

To obtain the magnetic fluid 470, ferromagnetic ultra-fine particles, e.g., magnetite fine-particles, are subjected to surface treatment and then are dispersed in a solvent. Because the magnetic fluid 470 is arranged between the magnetic circuit 4 and the diaphragm 6, the magnetic fluid 470 has the function of diminishing the contact between the magnetic circuit 4 and the diaphragm 6.

The close contact between the plate 2 and the diaphragm 6 through the magnetic fluid 470 makes it possible to improve the heat dissipation characteristics of the voice coil 7 as compared with a conventional voice coil. In turn, the improvement of the heat dissipation makes it possible to set a relatively high input-withstand voltage.

As compared with a conventional magnetic circuit, in the magnetic circuit 4 with the aforementioned structure, there is a relatively large amount of vertical component of the magnetic flux. Accordingly, an unnecessary horizontal force may possibly occur in the drive system including the diaphragm 6 and the voice coil 7. In this case, when the magnetic fluid 470 is arranged as described above, the horizontal vibration in the drive system can be decreased.

In a conventional magnetic circuit, the magnetic gap in the magnetic circuit is relatively narrow. For this reason, the magnetic fluid 470 is placed so as to surround the voice coil 7 in the magnetic gap, so that the mechanical resistance occurring in the operation of the voice coil 7 becomes relatively high. As a result, an f0 may possibly significantly rise to degrade the frequency characteristics.

On the other hand, in the speaker 100*k* according to the present invention, the magnetic fluid 470 is disposed between the plate 2 and the diaphragm 6. Accordingly, as compared with a conventional speaker, the mechanical resistance occurring in the operation of the voice coil 7 is small, which makes it possible to diminish a reduction in response (sensitivity) to the input signal.

In the magnetic circuit 4 having a flat-shaped plate 2 and a yoke 3, the magnetic-flux density around the end portion of the plate 2 is relatively high. Hence, the voice coil 7 and the diaphragm 6 are required to place as closer to the end portion of the plate 2 as possible. However, if the voice coil 7 and/or the diaphragm 6 are simply placed close to the plate 2, they may possibly come into contact with each other when the voice coil 7 is operated. By contrast, since the speaker 100*k* according to the ninth embodiment has the magnetic fluid 470 arranged as described above, this makes it possible to prevent an abnormal noise from being produced by the contact of the plate 2 with the diaphragm 6 or the voice coil 7, as well as making it possible to provide a relatively high magnetic-flux density in the vicinity of the voice coil 7.

When a relatively high frequency range is reproduced, the suppression of the undesired vibration of the diaphragm in a low frequency range is available in the present invention.

[Tenth Embodiment]

Figure 16:
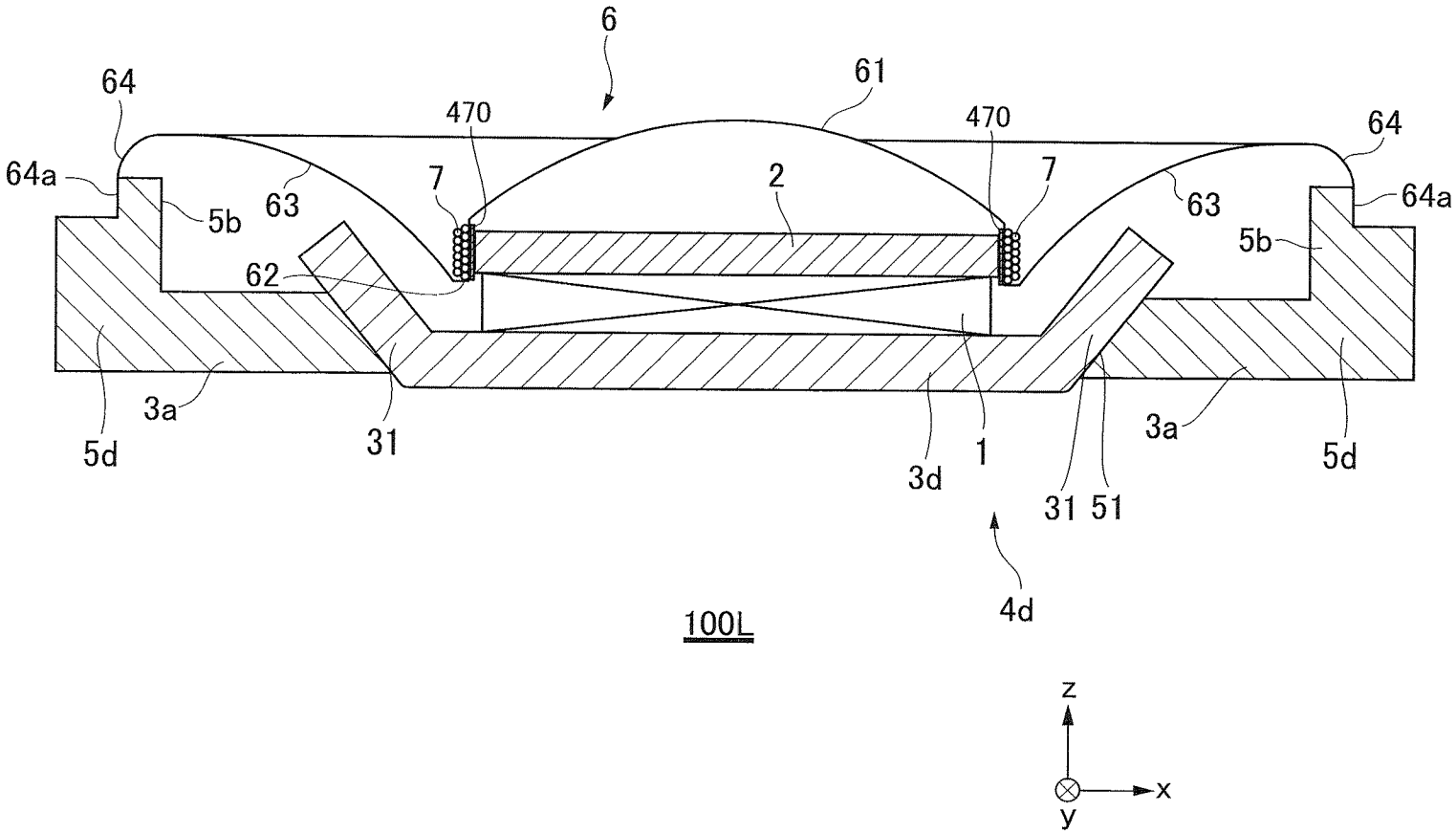
FIG. 16 is a sectional view illustrating a speaker 100L according to a tenth embodiment of the present invention.

FIG. 16 is a sectional view illustrating a speaker 100L according to a tenth embodiment of the present invention. The description of the components common to this embodiment and the first to ninth embodiments is partially omitted. As shown in FIG. 16, the speaker 100L according to the tenth embodiment has the same magnetic circuit 4*d* as that described in the fourth embodiment. A magnetic fluid 470 is held (disposed) in place between the plate 2 and either the diaphragm 6 or the voice coil 7.

That is, the shape of the magnetic circuit is not limited to ones as described above in the ninth embodiment and the tenth embodiment. What is required is that the magnetic gap in the magnetic circuit has a relatively large size and that the magnetic fluid 470 is held (disposed) between the plate 2 and either the diaphragm 6 or the voice coil 7.

Figure 17:
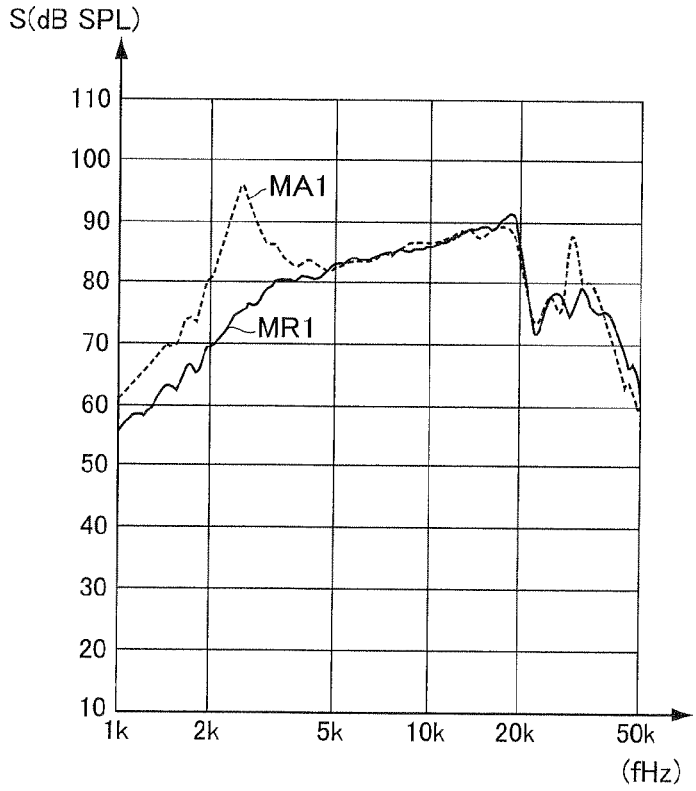
FIG. 17(*a*) is a graph showing the frequency characteristics of the speaker 100*k* according to the ninth embodiment with or without magnetic fluid to be provided.
Figure 17:
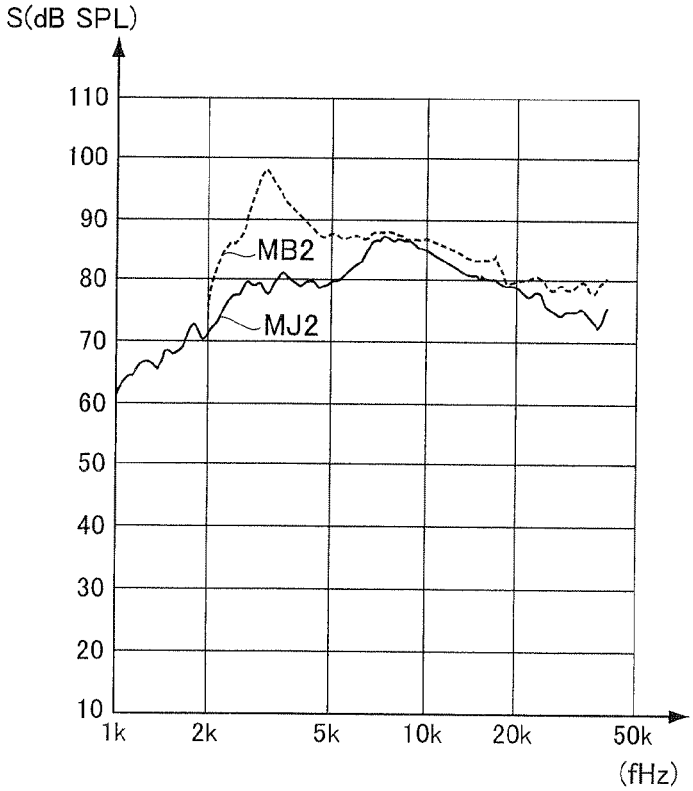

FIG. 17(A) is a graph showing the frequency characteristics of the speaker k according to the ninth embodiment with and without the magnetic fluid 470 being provided. FIG. 17(*b*) is a graph showing the frequency characteristics when the speaker k having a conventional magnetic circuit with a relatively narrow magnetic gap is or is not provided with the magnetic fluid 470. The horizontal axis represents frequency (fHz) and the vertical axis represents SPL (Sound Pressure Level) (SdB). Specifically, a dotted line MA1 shows frequency characteristics when the magnetic fluid 470 is not provided between the magnetic circuit and the voice coil. A solid line MR1 shows frequency characteristic when the magnetic fluid 470 is provided between the magnetic circuit and the voice coil. A dotted line MB2 shows frequency characteristics when the magnetic fluid is not provided, and a solid line MJ2 shows ones when the magnetic fluid is provided.

As shown in FIG. 17(A), it was verified that the frequency characteristics in a bass range (about 1 k to 5 kHz) is improved when the magnetic fluid 470 is provided between the magnetic circuit and the voice coil. As shown in FIGS. 17(A) and 17(B), the sensitivity was approximately equal to that of the conventional magnetic circuit.

In addition, as described earlier, in the magnetic circuit 4 of the speaker 100*k* illustrated in FIG. 14, the amount of magnetic fluid 470 can be reduced as compared with the case of the conventional magnetic circuit, leading to a reduction of costs.

[Embodiment of Outer-Magnet-Type Magnetic Circuit]

FIG. 18 to FIG. 21 are sectional views illustrating speakers 100*m* to 100*p* according to the embodiment of the present invention. The components common to this embodiment and the aforementioned embodiments are designated by the same reference numerals as those in the embodiments, and a description is partially omitted. Each of the speakers 100*m* to 100*p* according to the embodiment includes an outer-magnet-type magnetic circuit, in which the magnet 1 is disposed outside the voice coil 7.

Specifically, each of the speakers 100*m* to 100*p* has an outer-magnet-type magnetic circuit 4 provided with a magnet 1, a plate 2 disposed on one pole of the magnet 1 and a yoke 3 disposed on the other pole of the magnet 1, a voice coil 7 disposed close to an end portion of the plate 2 of the magnetic circuit 4, and a diaphragm 6 supporting the voice coil 7 in place close to the end portion of the plate 2 while allowing the voice coil 7 to vibrate. The yoke 3 is formed in an approximately flat plate shape having a diameter equal to or larger than that of the plate 2.

Figure 18:
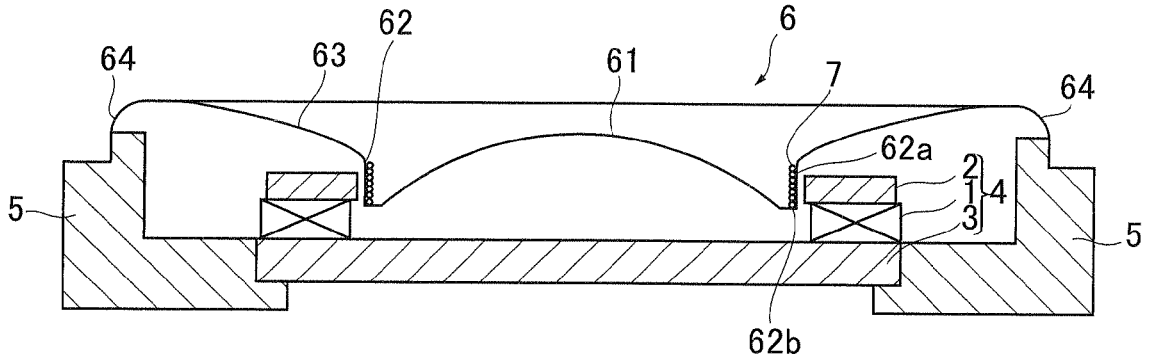
FIG. 18 is an illustrative view showing an embodiment of a speaker 100*m* including an outer-magnet-type magnetic circuit, of the embodiments of the present invention.

In the speaker 100*m* illustrated in FIG. 18, the ring-shaped magnet 1 is placed on the flat disk shaped yoke 3 having approximately the same outer diameter as that of the ring-shaped magnet 1. In turn, the ring-shaped plate 2 having an inner diameter slightly smaller than that of the magnet 1 is placed on the magnet 1. Thus, the outer-magnet-type magnetic circuit 4 is formed. A voice coil bobbin 62 is located inside the plate 2, and the voice coil 7 is placed in the voice coil bobbin 62, so that the voice coil 7 is supported within a magnetic force space created inside the plate 2.

As in the case of the aforementioned embodiments, the diaphragm 6 in this embodiment has a dome-shaped vibrating section 61, a voice coil bobbin 62, a cone-shaped vibrating section 63 and an outer rim 64. The outer periphery of the dome-shaped vibrating section 61 connects directly to the lower end of the voice coil bobbin 62, and then the upper end of the voice coil bobbin 62 connects directly to the inner periphery of the cone-shaped vibrating section 63. By placing the voice coil 7 inside the voice coil bobbin 62, the diaphragm 6 supports the voice coil 7 in place close to the inner end of the plate 2 while allowing the voice coil 7 to vibrate.

A form of the voice coil bobbin 62 is substantially the same as that employed in the embodiment illustrated in FIG. 4. However, in the embodiment illustrated in FIG. 18, the vent portion 62*b* is created on the inner side of the tubular portion 62*b* so as to form a voice coil supporter.

Figure 19:
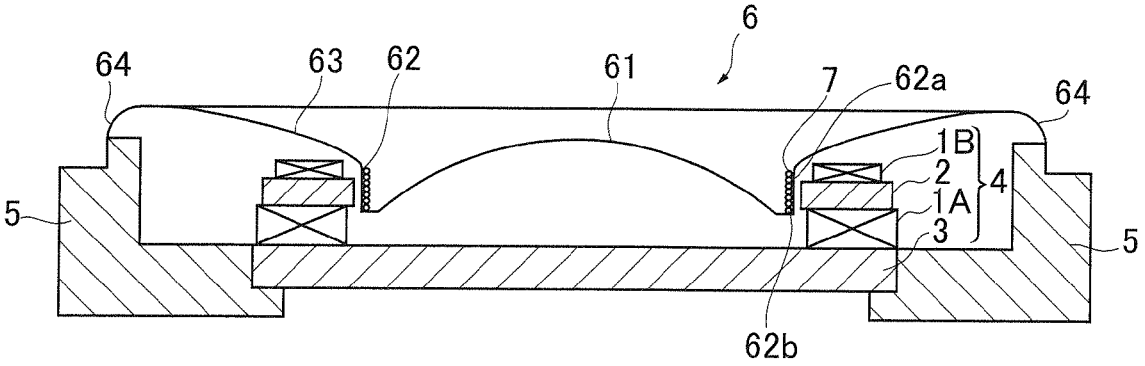
FIG. 19 is an illustrative view showing an embodiment of a speaker 100*n* including an outer-magnet-type magnetic circuit, of the embodiments of the present invention.

In the speaker 100*n* illustrated in FIG. 19, the ring-shaped magnet 1A is placed on the flat disk shaped yoke 3 having approximately the same outer diameter as that of the ring-shaped magnet 1A. In turn, the ring-shaped plate 2 having an inner diameter slightly smaller than that of the magnet 1A is placed on the magnet 1A. Then, a ring-shaped magnet 1B (repulsion magnet) having an inner diameter slightly larger than that of the plate 2 is placed on the plate 2. Thus, the outer-magnet-type magnetic circuit 4 is formed. A voice coil bobbin 62 is located inside the plate 2, and the voice coil 7 is placed in the voice coil bobbin 62, thereby supporting the voice coil 7 within a magnetic force space created inside the plate 2.

In the embodiment, the polarities on the opposing faces of the magnet 1A and the magnet 1B are the same, so that the magnetic lines of force are produced from the inner end of the plate 2 toward the upper face of the yoke 3 situated beneath the plate 2. In addition, the magnetic lines of force are produced from the upper face (facing the diaphragm 6) or the inner side face (facing the voice coil bobbin) of the magnet 1B toward the upper face of the yoke 3. As a result, the magnetic force space created inside the plate 2 can be expanded upward and downward, which makes it possible to generate vibrations of a large magnitude even when the audio current applied to the voice coil 7 is small. The diaphragm 6 is the same as that employed in the embodiment illustrated in FIG. 18.

Figure 20:
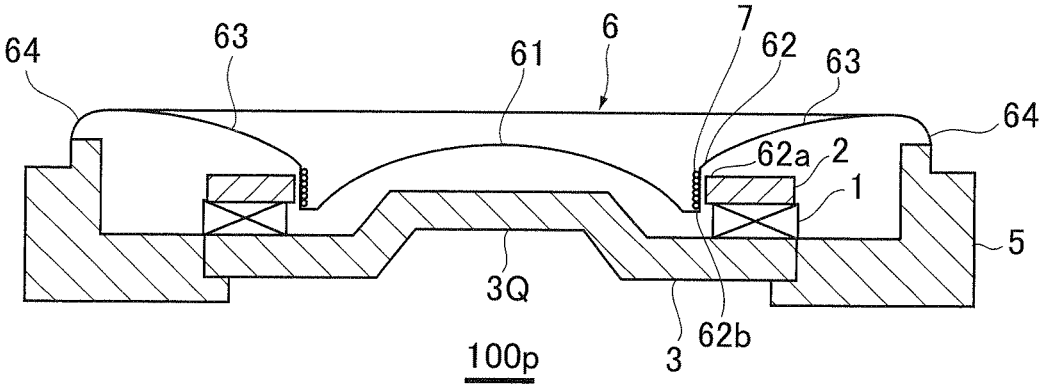
FIG. 20 is an illustrative view showing an embodiment of a speaker 100*p* including an outer-magnet-type magnetic circuit, of the embodiments of the present invention.

The embodiment illustrated in FIG. 20 is a modification of FIG. 18, in which the yoke 3 is formed in an approximately flat plate shape having a shape-altered portion 3Q protruding toward the plate 2 in the central portion (other components are the same as those in the embodiment illustrated in FIG. 18). According to the embodiment, because the shape-altered portion 3Q shortens the distance between the yoke 3 and the end portion of the plate 2, in particular, the inner end portion (inner end close to the protruding shape-altered portion 3Q), a high magnetic flux density can be provided, resulting in a speaker with a high sensitivity. In addition, since the direction of the magnetic lines of force passing from the inner end portion of the plate 2 toward the protruding shape-altered portion 3Q becomes almost horizontal, it is possible to cause the direction of the electromagnetic force acting on the voice coil 7 to pass along the inner end (facing the voice coil 7) of the plate 2. As a result, the vibrations can be effectively produced on the diaphragm 6.

Figure 21:
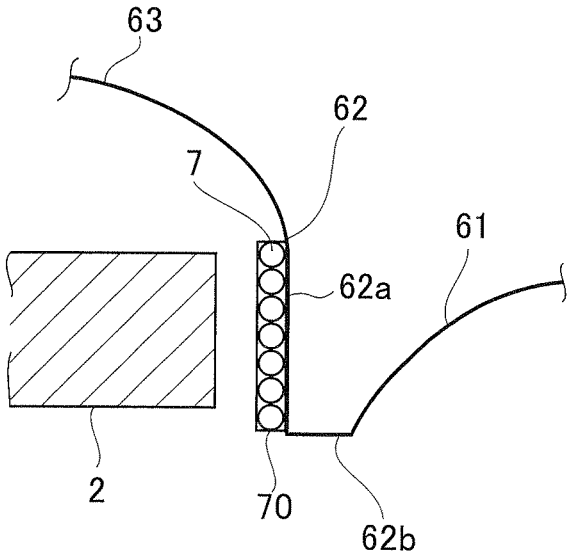
FIG. 21 is an illustrative view showing an embodiment (a modification of the diaphragm 6) of a speaker including an outer-magnet-type magnetic circuit, of the embodiments of the present invention.

The embodiment illustrated in FIG. 21 is a modification of the diaphragm 6 in the embodiments illustrated in FIG. 18 to FIG. 20. In the embodiments shown in FIG. 18 to FIG. 20, the voice coil 62 is disposed inside the voice coil bobbin 62. By contrast, in the embodiment shown in FIG. 21, the voice coil 7 is disposed outside the voice coil bobbin 62. In this case, the voice coil 7 is fixed to the rear side of the voice coil bobbin 62 with an adhesive 70. Hereinafter, the front side of the voice coil bobbin 62 is referred to as "the face on the front side of the diaphragm" and the rear side of the voice coil bobbin 62 is referred to as "the face on the reverse face of the diaphragm".

According to the embodiment, since the voice coil 7 is disposed on the rear side of the voice coil bobbin 62, it is possible to support the voice coil 7 in a position closer to the end of the plate 2. This enhances the magnetic flux density, resulting in a speaker with a high sensitivity to an input signal applied to the voice coil 7. In addition, since the voice coil 7 is placed on the reverse face of the diaphragm 6, the voice coil 7 is not visually recognized from the front side of the speaker. This improves the design property of the speaker.

[Embodiment of Simplified Magnetic Circuit]

Figure 22:
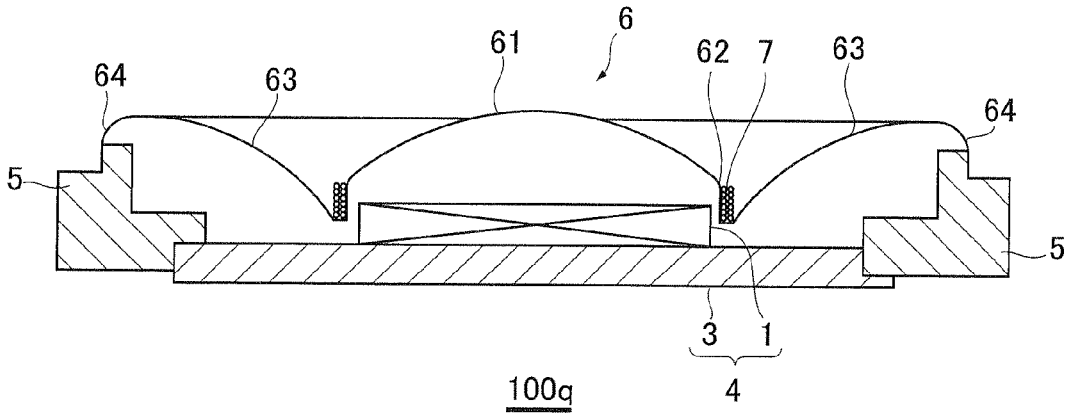
FIG. 22 is an illustrative view showing an embodiment of a speaker 100*q* including a simplified magnetic circuit, of the embodiments of the present invention.
Figure 23:
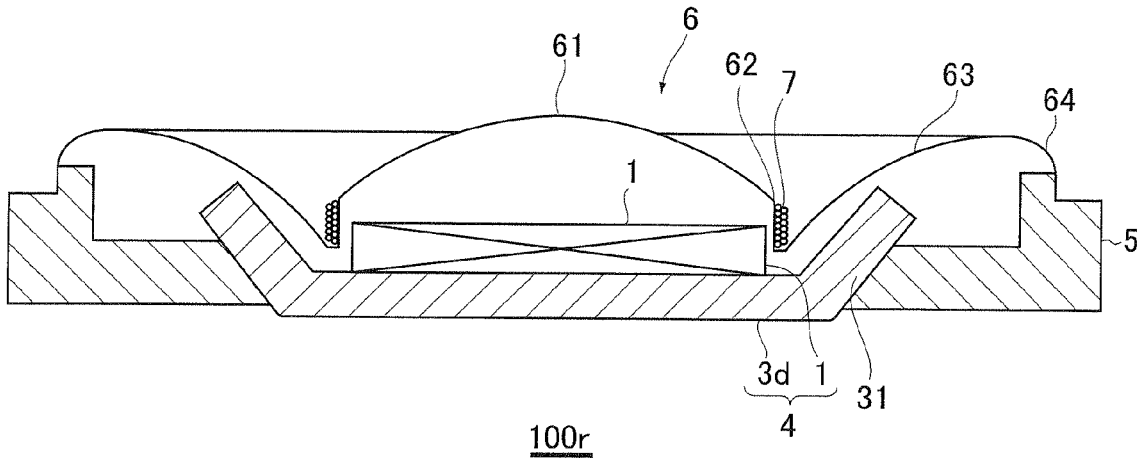
FIG. 23 is an illustrative view showing an embodiment of a speaker 100*r* including a simplified magnetic circuit, of the embodiments of the present invention.

FIG. 22 and FIG. 23 are sectional views illustrating speakers 100*q* and 100*r* according to the embodiment of the present invention. The components common to this embodiment and the aforementioned embodiments are designated by the same reference numerals, and a description is omitted. Each of the speakers 100*q* and 100*r* according to the embodiment includes a magnetic circuit simplified by omitting the plate.

Specifically, each of the speakers 100*q* and 100*r* includes a magnetic circuit 4 equipped with a magnet 1 and a yoke 3 disposed on one pole of the magnet 1, a voice coil 7 disposed close to the end of the magnet 1, and a diaphragm 6 supporting the voice coil 7 in place close to the end of the magnet 1 while allowing the voice coil 7 to vibrate. The yoke 3 is formed in an approximately flat plate shape.

In the speaker 100*q* illustrated in FIG. 22, the disk-shaped magnet 1 is mounted on the central portion of the flat-disk-shaped yoke 3 to form the magnetic circuit 4. The voice coil bobbin 62 is located outside of the magnet 1. The voice coil 7 is mounted on the outer side of the voice coil bobbin 62. In this manner, the voice coil 7 is supported within the magnetic force space created outside the magnet 1.

As in the case of the aforementioned embodiments, the diaphragm 6 in the embodiment has a dome-shaped vibrating section 61, a voice coil bobbin 62, a cone-shaped vibrating section 63 and an outer rim 64. The outer periphery of the dome-shaped vibrating section 61 connects directly to the upper end of the voice coil bobbin 62, and then the lower end of the voice coil bobbin 62 connects directly to the inner periphery of the cone-shaped vibrating section 63. By placing the voice coil 7 outside the voice coil bobbin 62, the diaphragm 6 supports the voice coil 7 in place close to the outer end of the magnet 1 while allowing the voice coil 7 to vibrate.

The embodiment illustrated in FIG. 23 is a modification of FIG. 22, in which the end portion 31 of the yoke 3 is bent toward the magnet 1, so that the yoke 3 is formed in an approximately flat plate shape (dish shape) (other components are the same as those in the embodiment illustrated in FIG. 22). According to the embodiment, because the bending shape of the end portion 31 shortens the distance between the yoke 3 and the outer end portion of the magnet 1, a high magnetic flux density can be provided, resulting in a speaker with a high sensitivity. In addition, since the direction of the magnetic lines of force passing from the outer end portion (close to the voice coil 7) of the magnet 1 toward the end portion 31 of the yoke 3 becomes almost horizontal, it is possible to cause the direction of the electromagnetic force acting on the voice coil 7 to pass along the outer end (facing the voice coil 7) of the magnet 1. As a result, the vibrations can be effectively produced on the diaphragm 6.

[Modification of Diaphragm]

The diaphragm 6 of the aforementioned embodiments is structured by molding the dome-shaped vibrating section 61, the voice coil bobbin 62, the cone-shaped vibrating section 63 and the outer rim 64 together into one piece. However, one or more than one of these components may be provided as a separate member. If separate members form the respective component, there is a beneficial advantage of facilitating the adjustment of sound quality. For example, the cone-shaped vibrating section 63 and the dome-shaped vibrating section 61 are formed of hard materials, while the outer rim 64 is formed of soft materials. In this case, the reproduction limit can be expanded in both a high frequency and a low frequency. Specifically, a further rise in the frequency in the high pitched sound and a further drop in the frequency in the low pitched sound are made possible, resulting in a speaker with a wide frequency band for reproduction. In addition, a conventional one-piece molding process has the disadvantage of the drawing process being difficult depending on materials. However, when the diaphragm consists of separate members, the process for each component is facilitated.

Figure 24:
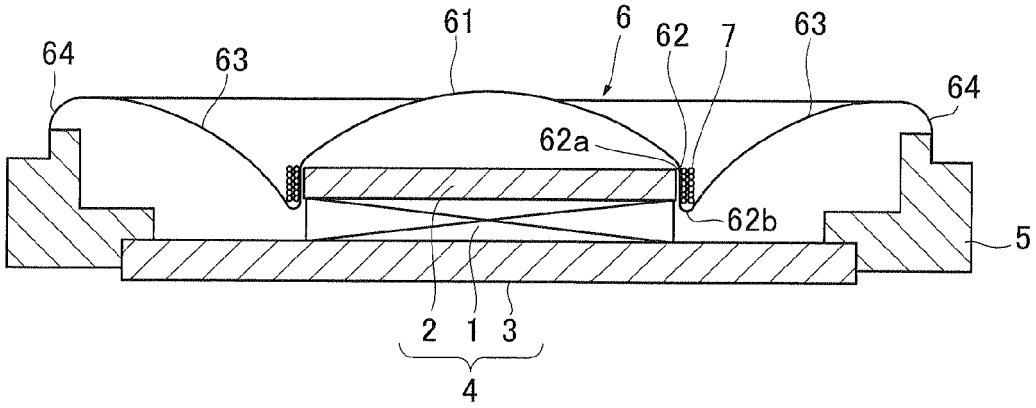
FIG. 24 is a sectional view of speakers according to the embodiments of the present invention, including modifications of the diaphragms.
Figure 24:
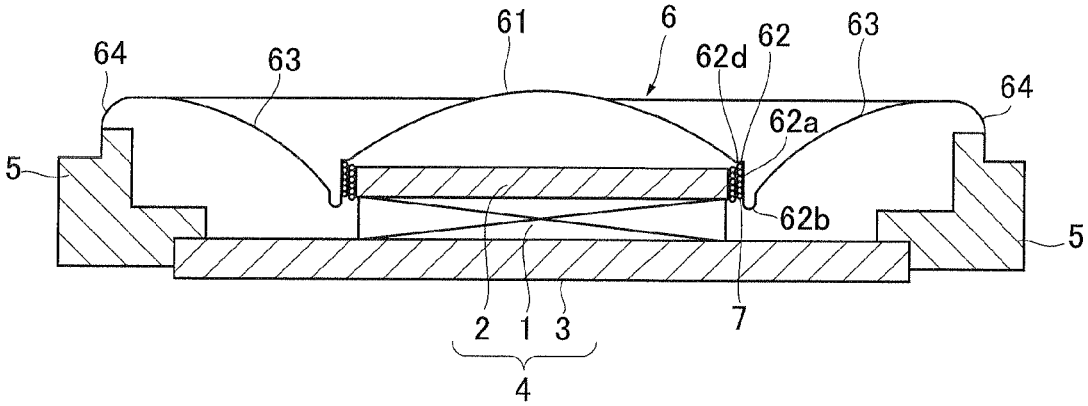
Figure 24:
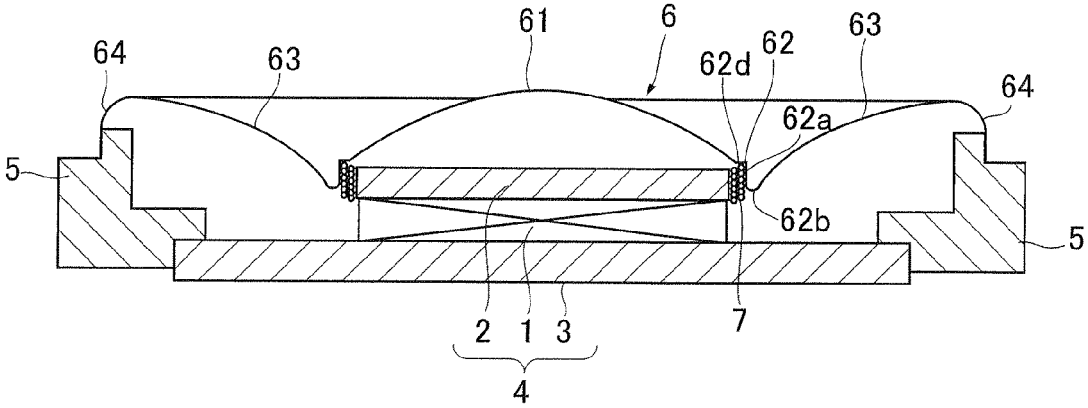
Figure 25:
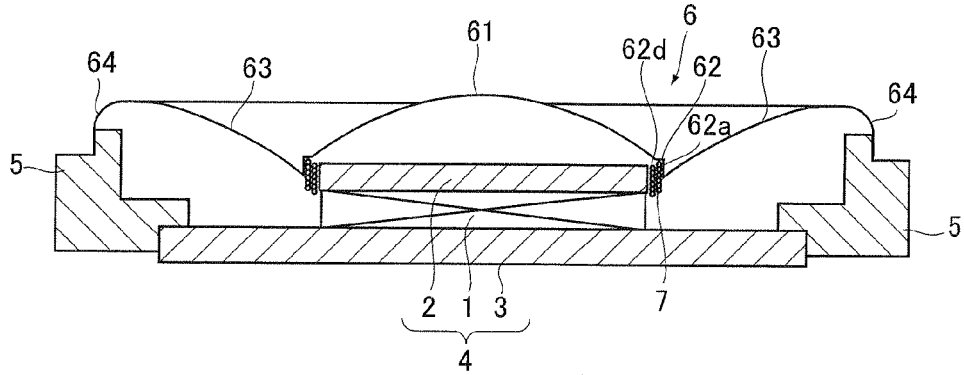
FIG. 25 is a sectional view of speakers according to the embodiments of the present invention, including modifications of the diaphragms.
Figure 25:
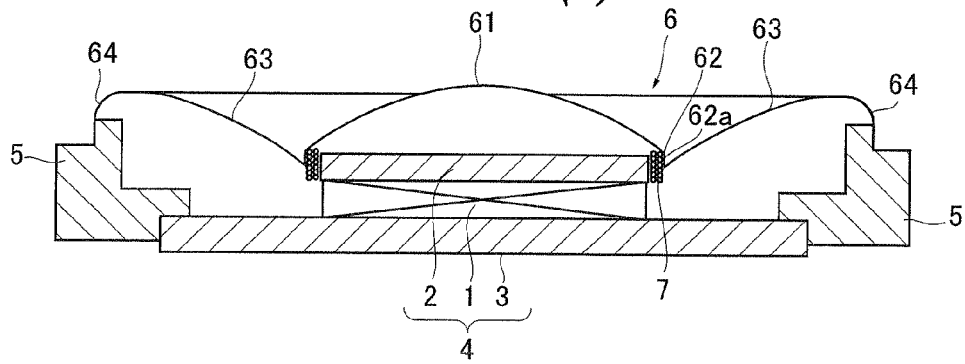
Figure 25:
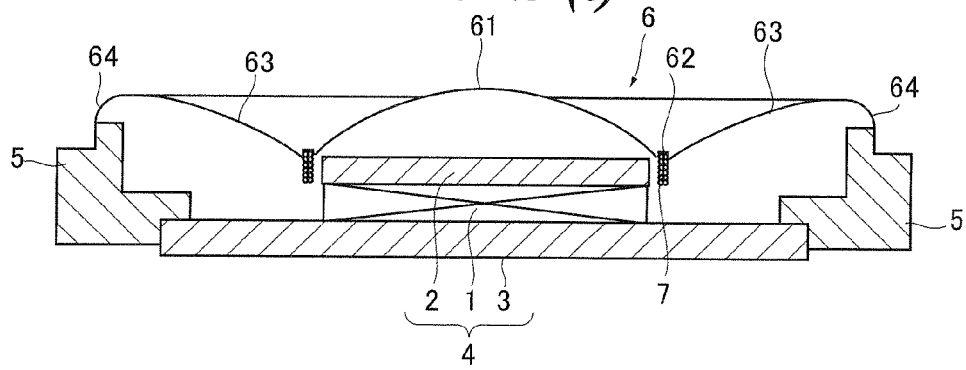
Figure 25:
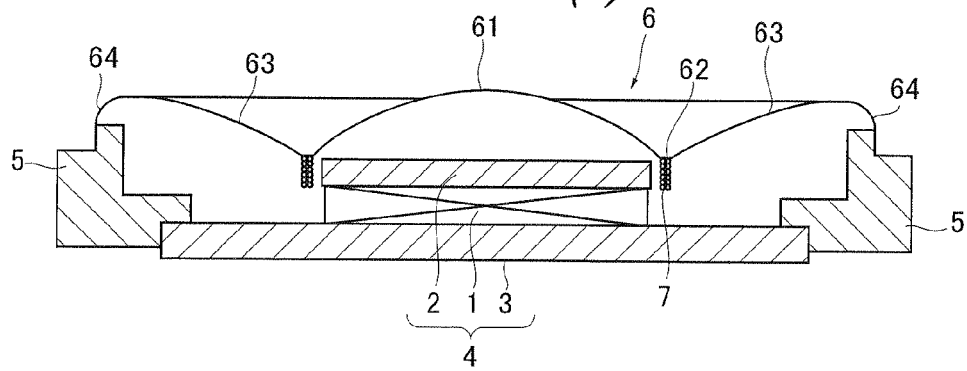
Figure 26:
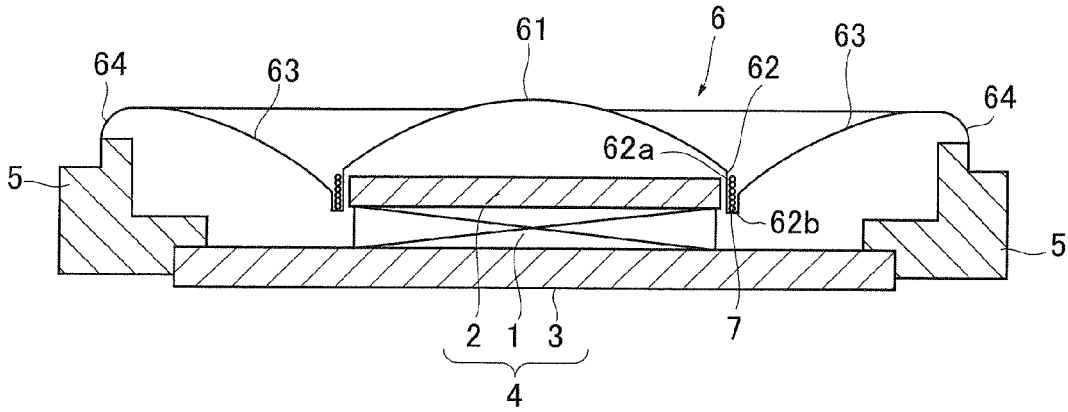
FIG. 26 is a sectional view of speakers according to the embodiments of the present invention, including modifications of the diaphragms.
Figure 26:
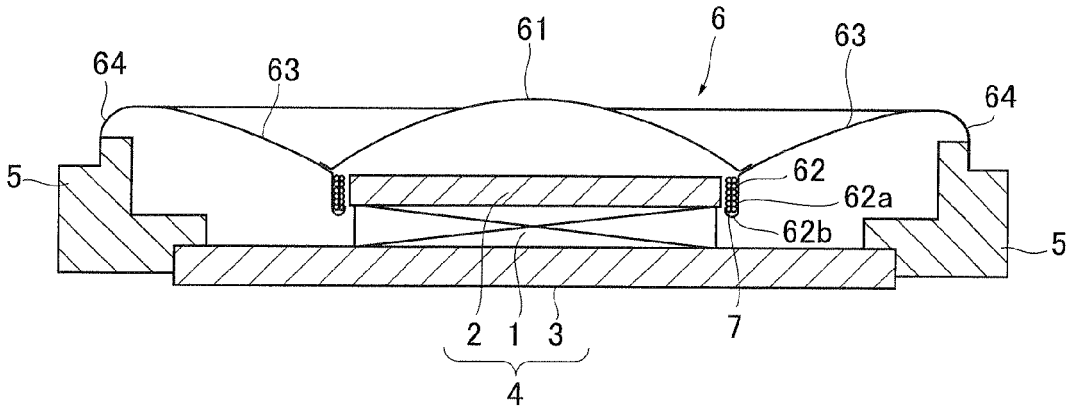
Figure 26:
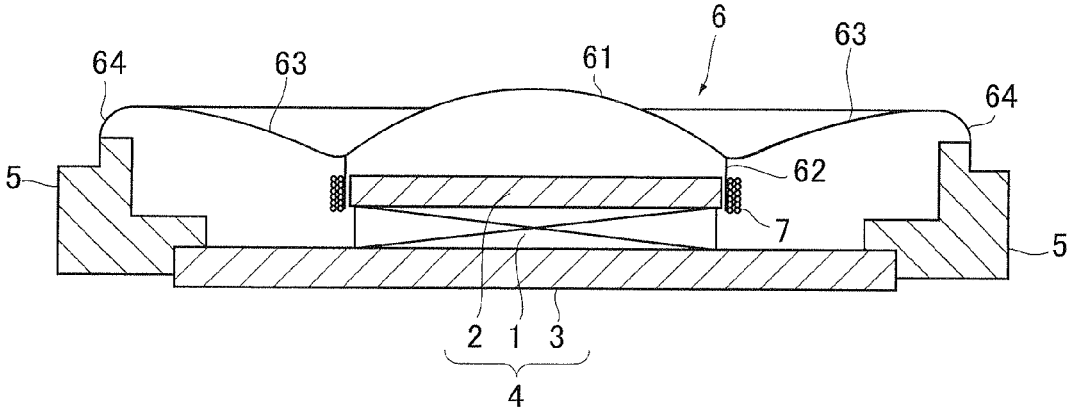

FIG. 24, FIG. 25 and FIG. 26 are sectional views illustrating the speakers according to the embodiments of the present invention comprising modifications of the diaphragms (same components as those described earlier are designated by the same reference numerals and a repeated description is omitted). Examples of employing the inner magnet magnetic circuit will be described below.

The examples shown in FIG. 24 are of the voice coil bobbin 62 having a bent portion 62*b* formed in an arc-shaped cross-sectional shape. FIG. 24(*a*) illustrates the example of the bent portion 62*b* bent outward so that the voice coil 7 is mounted outside the tubular portion 62*a*. FIG. 24(*b*) illustrates the example when the arc-shaped cross section bent portion 62*b* is provided on the outer side of the lower end of the voice coil bobbin 62, and a bent portion 62*d* bent inward is provided at the upper end of the voice coil bobbin 62 so that the voice coil 7 is mounted inside the tubular portion 62*a*. FIG. 24(*c*) illustrates the example when, in the example in FIG. 24(*b*), the length of the bent portion 62*b* is set shorter than the length of the voice coil 7.

The examples shown in FIG. 25 are of the voice coil bobbin 62 partially supporting the voice coil 7. FIG. 25(*a*) illustrates the example when the voice coil 7 is supported by the bent portion 62*d* formed on the inner side of the upper end of the voice coil bobbin 62, and the tubular portion 62*a* having a length shorter than that of the voice coil 7. FIG. 25(*b*) illustrates the example when the voice coil 7 is supported by the tubular portion 62*a* having a length shorter than that of the voice coil 7 without the bent portion. FIG. 25(*c*) illustrates the example when an upper portion of the voice coil 7 is supported by the C-shaped voice coil bobbin 62 (voice coil supporter) having the downward-facing open end. FIG. 25(*d*) illustrates the example when an upper portion of the voice coil 7 is supported by the voice coil bobbin 62 formed between the dome-shaped vibrating section 61 and the cone-shaped vibrating section 63.

The examples illustrated in FIG. 26 are other modifications. FIG. 26(*a*) illustrates the example when C-shaped bent portion 62*d* is formed on the outside of the voice coil bobbin and the voice coil 7 is mounted outside the tubular portion 62*a*. In the example illustrated in FIG. 26(*b*), the voice coil bobbin 62 and the cone-shaped vibrating section 63 are molded together in one piece, then the dome-shaped vibrating section 61 is formed separately, and then the outer periphery of the dome-shaped vibrating section 61 is connected to the inner periphery of the cone-shaped vibrating section 63. The arc-shaped cross section bent portion 62*b* having the inward-facing open end is formed at the lower end of the voice coil bobbin 62. Then, the voice coil 7 is mounted inside the tubular portion 62*a*. Finally, in the example shown in FIG. 26(*c*), the dome-shaped vibrating section 61 and the cone-shaped vibrating section 63 are molded together in one piece, and then the upper end of the voice coil bobbin 62 is connected to the boundary between the vibrating sections 61 and 63.

The present invention is not limited to the aforementioned embodiments. For example, the speaker and the magnetic circuit according to the present invention may be carried out by combining the aforementioned embodiments.

In addition, for example, the aforementioned embodiments have descried the circular shaped speaker, but the form of the speaker is not limited this. For example, the speaker according to the present invention is applicable to speakers of various shapes such as approximately oval shape, approximately rectangular shape, and flat shape.

The magnetic fluid is provided in part of the aforementioned embodiments, but the magnetic fluid can be provided in all the aforementioned embodiments of the present invention, without being limited to the illustrative forms. In terms of the embodiments of the present invention, what is required is that the magnetic fluid is held (disposed) in place between the voice coil and a part of the magnetic circuit either directly or through the diaphragm.

As described above, the speaker according to the present invention comprises: either an inner or outer-magnet-type magnetic circuit 4 provided with a magnet 1, a plate 2 disposed on one pole of the magnet 1, and a yoke 3 disposed on the other pole of the magnet, or the magnetic circuit 4 without the plate 2; a voice coil 7 disposed close to an end of the magnetic circuit 4; and a diaphragm 6 supporting the voice coil 7 in place close to the end of the magnetic circuit while allowing the voice coil 7 to vibrate. In this speaker, since the yoke is formed in an approximately flat plate shape, is it possible to provide a high performance speaker with a simple structure magnetic circuit without requiring a complicated process.

The diaphragm 6 includes a dome-shaped vibrating section 61 formed in a central portion of the diaphragm 6, a cone-shaped vibrating section 63 having the outer periphery either directly or indirectly supported by the speaker frame 5, and a voice coil bobbin 62 which is formed between the dome-shaped vibrating section 61 and the cone-shaped vibrating section 63 and shaped in an L-shaped cross section bending outward from an end of a tubular portion in which the voice coil 7 is mounted. Because the dome-shaped vibrating section 61 and the voice coil bobbin 62 and the cone-shaped vibrating section 63 are molded together in one piece, it is possible to provide a high performance speaker comprising a simple structure diaphragm without requiring a difficult process for forming a U shape of a narrow width in the diaphragm, for example.

The invention claimed is:

1. A speaker comprising:

a magnet;

an inner-magnet-type magnetic circuit provided with a yoke that is formed in a substantially flat plate and is disposed on one pole of said magnet;

a voice coil disposed close to an end of said magnet; and a diaphragm supporting said voice coil in place close to the end of said magnet while allowing the voice coil to vibrate, wherein said diaphragm includes:

an outer periphery; and a vibrating section formed in the outer periphery side of said diaphragm with respect to said voice coil, wherein:

said magnetic circuit includes a space formed in the outer periphery side of said diaphragm with respect to said coil;

the space is formed by at least said magnet and said yoke disposed at the outer periphery side of said diaphragm with respect to said magnet, and said vibrating section extends from a lower end portion of said voice coil toward the outer periphery of said diaphragm and passes through the space.

2. The speaker according to claim 1, further comprising a plate disposed on one pole of said magnet, wherein the space is formed by said magnet, said yoke disposed in the outer periphery side of said diaphragm with respect to said magnet, and said plate.

3. The speaker according to claim 2, wherein said magnet, said plate and said yoke have a through-hole formed along their axis directions.

4. The speaker according to claim 2, wherein said approximately flat-plate-shaped yoke has an end formed in a cone shape bending toward said plate.

5. The speaker according to claim 2, further comprising an equalizer made of a magnetic material and disposed close to said voice coil and said plate on a front face of said diaphragm.

6. The speaker according to claim 5, wherein:

said equalizer has a ring-shaped portion disposed close to said voice coil and said plate on the front face of said diaphragm, and said ring shaped portion is formed in a diameter smaller than a diameter of said yoke.

7. The speaker according to claim 2, further comprising a repulsion magnet having a same polarity as that of an upper face of said magnet and placed on an upper face of said plate.

8. The speaker according to claim 2, further comprising a magnetic fluid held in place between said plate and said voice coil, or between said magnet and said voice coil either directly or through said diaphragm.

9. The speaker according to claim 1, wherein:

said voice coil is disposed along a direction of a thickness of said magnet; and a surface of said yoke facing a surface of said vibrating section constitutes the space.

10. The speaker according to claim 9, wherein said yoke has a diameter larger than that of said voice coil.

11. The speaker according to claim 10, wherein:

said diaphragm includes a voice coil supporter at least supporting said voice coil, and said vibrating section formed in a ring shape;

said voice coil supporter is supported in said vibrating section;

said vibrating section has an inner periphery portion disposed lower than an upper end portion of said voice coil; and said vibrating section has an outer periphery portion extending outward.

12. The speaker according to claim 11, wherein the inner periphery portion of said vibrating section or an outer periphery portion of another vibrating section formed in a center side of said diaphragm with respect to said voice coil is disposed close to a lower end portion of said voice coil.

13. The speaker according to claim 9, wherein said diaphragm has:

a first vibrating section of a dome shape formed in the center side of said diaphragm with respect to said voice coil;

a second vibrating section of a cone shape that is formed in the outer periphery side of said diaphragm with respect to said voice coil and has the outer periphery portion either directly or indirectly supported by a speaker frame; and a voice coil bobbin which is formed between said first vibrating section and said second vibrating section and on which said voice coil is mounted.

14. The speaker according to claim 13, wherein one or more than one of said first vibrating section, said second vibrating section and said voice coil bobbin is formed of a separate member.

15. The speaker according to claim 14, wherein said voice coil bobbin has a tubular portion in which said voice coil is mounted and a bent portion bent either outward or inward from an end of the tubular portion.

16. The speaker according to claim 9, wherein:

said diaphragm has a fitting element formed at an end of said diaphragm and engaging with a fitted element formed in said speaker frame; and said fitting element of said diaphragm and said fitted element of said speaker frame are fitted together to position said diaphragm and said speaker frame.

17. The speaker according to claim 14, wherein said diaphragm has the outer periphery formed in a tubular shape, and an inner side face of the tubular outer periphery is fixed to an outer side face of an engagement step formed on said speaker frame.

18. The speaker according to claim 15, wherein said voice coil is secured to an L-shaped cross-sectional portion of said voice coil bobbin with an adhesive.

19. The speaker according to claim 9, wherein said yoke made of a metallic material and said speaker frame made of a resin material are formed together in one piece by an insert forming process.

20. The speaker according to claim 19, wherein said speaker frame and said yoke are molded together in one piece using a metallic material.

21. I he speaker according to claim 20, wherein said yoke is provided with a bent portion bent toward an end of said plate, and has a securing portion provided at an outer end beyond the bent portion for securing said diaphragm.

22. The speaker according to claim 9, wherein said diaphragm is made of a metallic material.

23. The speaker according to claim 1, wherein the outer periphery of said diaphragm is supported by said yoke.

* * * * *